US005858612A

United States Patent [19]

Inoue et al.

[11] Patent Number: 5,858,612

[45] Date of Patent: Jan. 12, 1999

[54] METHOD FOR FORMING IMAGE

[75] Inventors: Nobuaki Inoue; Kouta Fukui, both of Kanagawa, Japan

[73] Assignee: Fuji Photo Film Co., Ltd., Kanagawa, Japan

[21] Appl. No.: 861,723

[22] Filed: May 22, 1997

Related U.S. Application Data

[63] Continuation of Ser. No. 597,970, Feb. 7, 1996, abandoned.

[30] Foreign Application Priority Data

Feb. 13, 1995 [JP] Japan ..... 7-046622

[51] Int. Cl.[6] ..... G03C 5/29

[52] U.S. Cl. ..... 430/264; 430/440; 430/446

[58] Field of Search ..... 430/264, 440, 430/446

[56] References Cited

U.S. PATENT DOCUMENTS

| | | | |
|---|---|---|---|
| 5,264,323 | 11/1993 | Purol et al. | 430/264 |
| 5,478,697 | 12/1995 | Sakai et al. | 430/264 |
| 5,480,886 | 1/1996 | Yamazaki et al. | 430/264 |
| 5,496,681 | 3/1996 | Ezoe et al. | 430/264 |
| 5,550,003 | 8/1996 | Inoue | 430/264 |
| 5,654,124 | 8/1997 | Yamaguchi | 430/264 |

*Primary Examiner*—Hoa Van Le

*Attorney, Agent, or Firm*—Sughrue, Mion, Zinn, Macpeak & Seas, PLLC

[57] ABSTRACT

A method for forming a superhigh contrast image which comprises the steps of image-exposing a silver halide photographic material having a silver halide emulsion layer provided on a support, the layer comprising silver halide grains containing 50 mol % or more of silver chloride and $1\times10^{-8}$ to $1\times10^{-6}$ mol of a complex of rhodium, ruthenium, rhenium, or osmium per mol of silver halide, being spectrally sensitized so as to have the maximum sensitivity in the wavelength region of 750 nm or more, and further containing a hydrazine compound; and processing with a developer which contains a developing agent of a ascorbic acid type and does not substantially contain that of a dihydroxybenzene type, the silver halide photographic material being processed with the developer which causes less harm to the environment.

5 Claims, No Drawings

METHOD FOR FORMING IMAGE

This is a Continuation of application Ser. No. 08/597,970 filed Feb. 7, 1996, now abandoned.

FIELD OF THE INVENTION

The present invention relates to a method for forming an image by use of a silver halide photographic material which is spectrally sensitized in the infrared region, and particularly, to a method for forming a superhigh contrast image by use of a photographic material for a photomechanical process which is spectrally sensitized in the infrared region and improved in suitability for development processing.

BACKGROUND OF THE INVENTION

One of the methods for exposing a photographic material is concerned with a known method for forming an image by a so-called scanner system in which an original is scanned and a silver halide photographic material is exposed to light stemming from the image signal to form a negative or positive image equivalent to the image of the original.

There are various recording devices to which the method for forming an image by the scanner system is practically adopted. A glow lamp, a xenon lamp, a mercury lamp, a tungsten lamp, a light emitting diode, and others have hitherto been used as the sources of light for the recording devices of the scanner system. However, from a practical viewpoint, all these sources have the disadvantage of low output and short life. To overcome these drawbacks, coherent laser sources such as a Ne-He laser, an argon laser and a He—Cd laser have also been used as sources for the scanner system. Although high output is obtained from these sources, the devices equipped with them have the disadvantage of being large-sized and expensive and, in addition, need a modulator.

On the other hand, semiconductor lasers are small-sized, inexpensive, readily modulated, and have longer life than that of the above-mentioned lasers. In addition, because the semiconductor lasers emit light in the infrared region, a photosensitive material having sensitivity in the infrared region can be advantageously treated under a bright safe light so that operating efficiency of handling can be improved.

Photosensitive materials to which the semiconductor lasers having such advantages can be applied are commercially available in recent years, and further photosensitive materials having superhigh contrast come to be desired.

Photographic materials comprising silver halide grains containing silver chloride which have sensitivity to light emitted by the semiconductor lasers and, that is, are spectrally sensitized in the infrared region are described in JP-A-60-80841 (The term "JP-A" as used herein means an "unexamined published Japanese patent application"), JP-A-62-299838, JP-A-62-299839, JP-A-61-70550, JP-A-63-115159, JP-A-63-115160, and JP-A-63-115161.

Photographic materials of a silver bromide or silver iodobromide type are described in JP-A-63-49752, JP-A-63-83719 and JP-A-63-89838.

To improve the sensitivity in the infrared region, a number of sensitizing dyes have been hitherto developed, in addition to the sensitizing dyes described in the above-mentioned patent specifications. These sensitizing dyes are described in U.S. Pat. Nos. 2,095,854, 2,095,856, 2,955,939, 3,458,318, 3,482,978, 3,552,974, 3,573,921, 3,582,344, 3,615,632, and 4,011,083.

A system in which superhigh contrast can be achieved by adding a hydrazine compound to an emulsion spectrally sensitized in the infrared region is known and described in JP-A-64-26841, JP-A-2-35443, JP-A-2-184841, and JP-A-2-113238. The photographic materials described in these patent specifications, which can be treated with developers of pH 11.0 or less, are liable to cause fogging and black peppers.

In the system for which hydrazines are used, photographic materials containing silver chlorobromide which is subjected to chemical sensitization are disclosed in JP-A-53-20921, JP-A-60-83028, JP-A-60-140399, JP-A-63-46437, JP-A-63-103230, JP-A-3-294844, JP-A-3-294845, JP-A-4-174424, JP-A-6-19035, and so forth. Further, photographic materials in which a silver halide emulsion contains a hydrazine compound together with a heavy metal complex such as rhodium and iridium are described in JP-A-60-83028, JP-A-61-47942, JP-A-61-47943, JP-A-61-29837, JP-A-62-201233, JP-A-62-235947, JP-A-63-103232, and so forth.

On the other hand, in the developers for photographic materials in the field of graphic arts, dihydroxybenzenes are used as a developing agent. Although hydroquinone is mostly used among the dihyroxybenzenes, the use of hydroquinone as the developing agent has seemed to have some disadvantages from the ecological and toxicological viewpoint in recent years.

Endiols such as ascorbic acid are known to function as a developing agent and attention is paid to the fact that they have no ecological and toxicological problems. For example, U.S. Pat. Nos. 2,688,549 and 3,826,654 have disclosed that a developer containing an endiol can form an image under a highly alkaline condition of pH 12 or higher at least. Further, the endiols are described in U.S. Pat. Nos. 5,236,816 and 5,098,819 from the viewpoint of developing agents that have no ecological and toxicological problems.

SUMMARY OF THE INVENTION

An object of the present invention is to provide a method for forming a superhigh contrast image by treating a silver halide photographic material having sensitivity in the infrared region with a developer which causes less harm to the environment.

The present invention provides a method for forming an image which comprises the steps of image-exposing a silver halide photographic material having a silver halide emulsion layer provided on a support, said silver halide emulsion layer comprising silver halide grains which contain 50 mol % or more of silver chloride and a complex of rhodium, ruthenium, rhenium, or osmium in an amount of $1\times10^{-8}$ to $1\times10^{-6}$ mol per mol of silver halide, being spectrally sensitized so as to have the maximum sensitivity in a long wavelength region of 750 nm or more, and further containing a hydrazine compound represented by the following general formula (I); and processing with a developer which contains a developing agent represented by the following general formula (II) and does not substantially contain a developing agent of a dihydroxybenzene type:

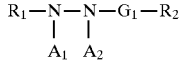

$$R_1-\underset{\underset{A_1}{|}}{N}-\underset{\underset{A_2}{|}}{N}-G_1-R_2 \qquad (I)$$

wherein $R_1$ represents an aliphatic group or an aromatic group; $R_2$ represents a hydrogen atom, an alkyl group, an aryl group, a unsaturated heterocyclic group, an alkoxyl group, an aryloxy group, an amino group, or a hydrazino group; $G_1$ represents a —CO— group, a —$SO_2$— group, a —SO— group, a

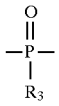

group, a —CO—CO— group, a thiocarbonyl group, or an iminoethylene group; both of $A_1$ and $A_2$ are hydrogen atoms, or one of $A_1$ and $A_2$ is a hydrogen atom and the other is a substituted or unsubstituted alkylsulfonyl group, a substituted or unsubstituted arylsulfonyl group, or a substituted or unsubstituted acyl group; $R_3$ represents one selected from the same groups as defined as $R_2$ and may be different from $R_2$ in a molecule:

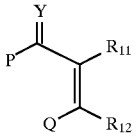

(II)

wherein $R_{11}$ and $R_{12}$ each represents a hydroxyl group, an amino group, an acylamino group, an alkylsulfonylamino group, an arylsulfonylamino group, an alkoxycarbonylamino group, a mercapto group, or an alkylthio group; P and Q each represents a hydroxyl group, a carboxyl group, an alkoxyl group, a hydroxyalkyl group, a carboxyalkyl group, a sulfo group, a sulfoalkyl group, an amino group, an aminoalkyl group, an alkyl group, or an aryl group, or P and Q may combine with each other to form one of 5- to 8-membered rings together with two vinyl carbon atoms to which $R_{11}$I and $R_{12}$ attach and with a carbon atom to which Y attaches; Y represents O or N—$R_{13}$; and $R_{13}$ represents a hydrogen atom, a hydroxyl group, an alkyl group, an acyl group, a hydroxyalkyl group, a sulfoalkyl group, or a carboxyalkyl group.

DETAILED DESCRIPTION OF THE INVENTION

General formula (I) is described in more detail.

In general formula (I), the aliphatic group represented by $R_1$ is preferably an alkyl group having 1 to 30 carbon atoms, and more preferably a straight-chain, branched-chain, or cyclic alkyl group having 1 to 20 carbon atoms. The branched-chain alkyl group may form a saturated heterocyclic ring containing one or more heteroatom in it by cyclization of a branched-chain moiety. This alkyl group may contain a substituent group.

In general formula (I), the aromatic group represented by $R_1$ is a monocyclic or dicyclic aryl group, or an unsaturated heterocyclic group. The unsaturated heterocyclic group may be fused by a monocyclic or dicyclic aryl group to form a heteroaryl group. Examples of such aromatic rings include a benzene ring, a naphthalene ring, a pyridine ring, a pyrimidine ring, an imidazole ring, a pyrazole ring, a quinoline ring, an isoquinoline ring, a benzimidazole ring, a thiazole ring, and a benzothiazole ring. Among these, aryl groups containing a benzene ring are preferred.

$R_1$ is particularly preferably an aryl group.

The aliphatic or aromatic group represented by $R_1$ may contain a substituent group. Examples of typical substituent groups include an alkyl group, an alkenyl group, an alkynyl group, an aryl group, a group containing a heterocyclic ring, a pyridinium ring, a hydroxyl group, an alkoxyl group, an aryloxy group, an acyloxy group, an alkyl- or arylsulfonyloxy group, an amino group, a carbonamido group, a sulfonamido group, a ureido group, a thioureido group, a semicarbazido group, a thiosemicarbazido group, a urethane group, a group containing a hydrazide structure, a group containing a quaternary ammonium structure, an alkyl- or arylthio group, an alkyl- or arylsulfonyl group, an alkyl- or arylsulfinyl group, a carboxyl group, a sulfo group, an acyl group, an alkoxy- or aryloxycarbonyl group, a carbamoyl group, a sulfamoyl group, a halogen atom, a cyano group, a phosphoramido group, a diacylamino group, an imido group, a group containing an acylurea structure, a group containing a selenium or tellurium atom, and a group containing a tertiary or quaternary sulfonium structure. Preferred substituent groups are a straight-chain, branched-chain, or cyclic alkyl group, (preferably having 1 to 20 carbon atoms), an aralkyl group (preferably an aryl moiety being a monocyclic or dicyclic group and an alkyl moiety having 1 to 3 carbon atoms), an alkoxyl group (preferably having 1 to 20 carbon atoms), a substituted amino group (preferably an amino group substituted by an alkyl group having 1 to 20 carbon atoms), an acylamino group (preferably having 2 to 30 carbon atoms), a sulfonamido group (preferably having 1 to 30 carbon atoms), a ureido group (preferably having 1 to 30 carbon atoms), and a phosphoramido group (preferably having 1 to 30 carbon atoms).

In general formula (I), the alkyl group represented by $R_2$ is preferably a group having 1 to 4 carbon atoms, and the aryl group is preferably an monocyclic or dicyclic group, for example, like a group including a benzene ring.

The unsaturated heterocyclic group represented by $R_2$ is a compound containing a 5- or 6-membered ring which contains at least one nitrogen atom, oxygen atom, or sulfur atom. Examples thereof include an imidazolyl group, a pyazolyl group, a triazolyl group, a tetrazolyl group, a pyridyl group, a pyridinium group, a quinolinium group, and a quinolinyl group. Among these, a pyridyl group and a pyridinium group are particularly preferred.

The alkoxyl groups represented by $R_2$ are preferably ones having 1 to 8 carbon atoms, the aryloxy groups are preferably monocyclic ones, and the amino groups are preferably a unsubstituted amino group, an alkylamino group having 1 to 10 carbon atoms, and an arylamino group.

These groups represented by $R_2$ may contain a substituent group. Examples of the substituent group include the same as defined as the substituent groups for $R_1$.

When $G_1$ is a —CO— group, examples of preferred groups represented by $R_2$ include a hydrogen atom, an alkyl group (for example, methyl, trifluoromethyl, 3-hydroxypropyl, 3-methanesulfonamidopropyl, and phenylsulfonylmethyl), an aralkyl group (for example, o-hydroxybenzyl), and an aryl group (for example, phenyl, 3,5-dichlorophenyl, o-methanesulfonamidophenyl, 4-methanesulfonylphenyl, and 2-hydroxymethylphenyl). Among these, a hydrogen atom and a fluoromethyl group are particularly preferred.

When $G_1$ is a —$SO_2$— group, examples of preferred groups represented by $R_2$ include an alkyl group (for example, methyl), an aralkyl group (for example, o-hydroxybenzyl), an aryl group (for example, phenyl), and a substituted amino group (for example, dimethylamino).

When $G_1$ is a —CO—CO— group, examples of preferred groups represented by $R_2$ include an alkoxyl group, an aryloxy group and an amino group.

As $G_1$ of general formula (I), the —CO— and —CO—CO— groups are preferably used, and the —CO— group is most preferred.

Further, $R_2$ may be cleaved into a $G_1$–$R_2$ moiety and the residual fragment, so that the $G_1$–$R_2$ moiety forms a cyclic structure containing atoms which constitute the moiety. Examples thereof are described in JP-A-63-29751 and so forth.

$A_1$ and $A_2$ are a hydrogen atom, an alkyl- or arylsulfonyl group having 20 or less carbon atoms (preferably a phenylsulfonyl group or a phenylsulfonyl group substituted so that a sum of Hammett's substituent constants amounts to−0.5 or more), an acyl group having 20 or less carbon atoms (preferably a benzoyl group or a benzoyl group substituted so that a sum of Hammett's substituent constants amounts to −0.5 or more, or a straight-chain, branched-chain or cyclic, and substituted or unsubstituted aliphatic acyl group (Examples of the substituent groups include a halogen atom, an ether linkage, a sulfonamido group, a carbonamido group, a hydroxyl group, a carboxyl group, and a sulfonic acid group)).

$A_1$ and $A_2$ are most preferably hydrogen atoms.

The substituent groups for $R_1$ and $R_2$ may contain additional substituent groups which are the same as defined as the substituent groups for $R_1$. The additional substituent groups may contain further additional substituent groups, and $R_1$ and $R_2$ may ultimately contain multiple substituent groups. These substituent groups also are preferably the same as defined as the substituent groups for $R_1$.

A ballasting group used commonly in immovable photographic additives such as couplers, or a polymer may be incorporated into $R_1$ or $R_2$ of general formula (I). The ballasting group is a group which has 8 or more carbon atoms and is relatively inactive to photographic properties. The group can be selected, for example, among an alkyl group, an aralkyl group, an alkoxyl group, a phenyl group, an alkyl-phenyl group, a phenoxy group and an alkylphenoxy group and others. Examples of the polymer are described in JP-A-1-100530.

A group for increasing adsorption on the surface of silver halide grains may be incorporated into $R_1$ or $R_2$ of general formula (I). Examples of such adsorbing groups include an alkylthio group, an arylthio group, a thiourea group, a heterocyclic thioamido group, a mercapto-heterocyclic group, and a triazol group, which are described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246.

In the present invention, particularly preferred hydrazine derivatives are ones in which $R_1$ represents a ballasting group, a group promoting adsorption on the surface of silver halide grains, a group containing a quaternary ammonium structure, or a phenyl group containing an alkylthio group, these groups linking to the nitrogen atom via a sulfonamido group, an acylamino group, or a ureido group; $G_1$ represents a —CO— group; and $R_2$ represents a hydrogen atom, substituted alkyl group, or substituted aryl group (preferably containing an electron attractive group or a hydroxymethyl group at the 2-position as a substituent group). $A_1$ combinations of $R_1$ and $R_2$ described above can be preferably used.

Examples of the compounds represented by general formula (I) are shown below. However, in the present invention, the compounds should not be construed as limiting to these examples.

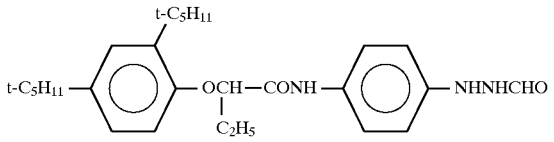

I-1

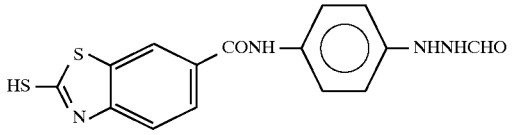

I-2

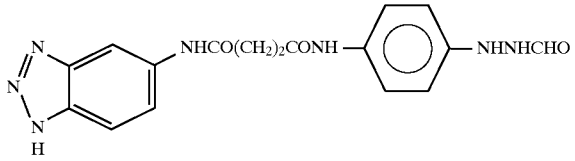

I-3

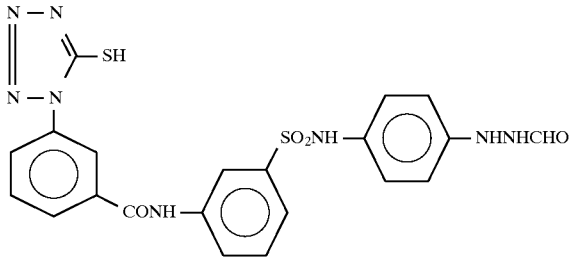

I-4

-continued
I-5
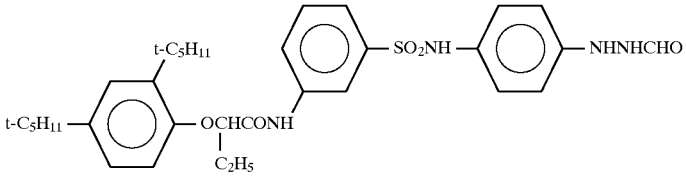
I-6
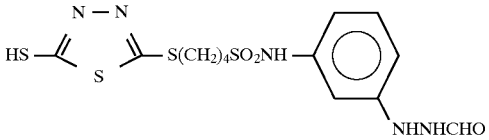
I-7
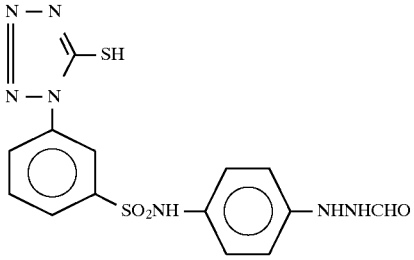
I-8
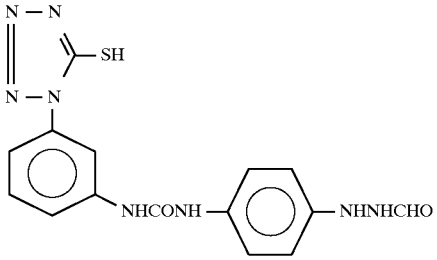
I-9
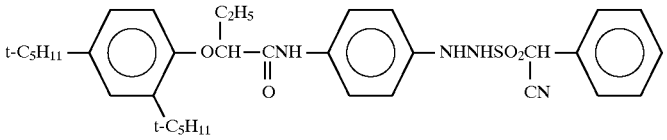
I-10
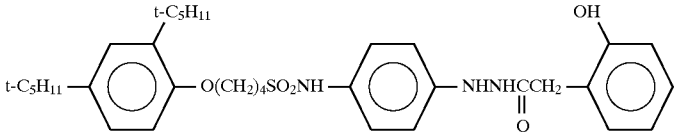
I-11
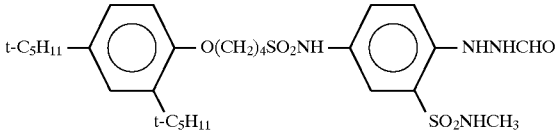
I-12
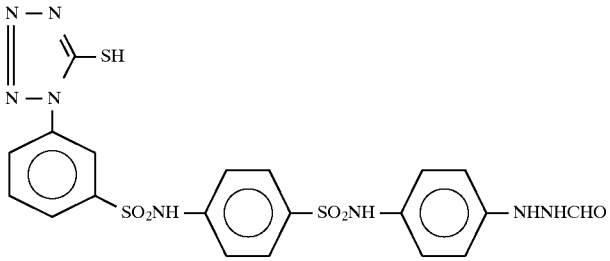

-continued
I-13
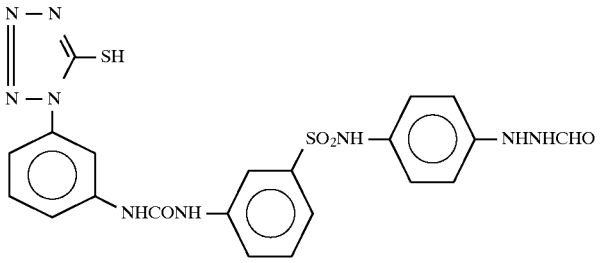
I-14
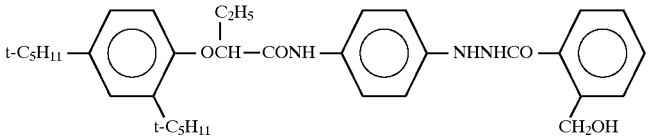
I-15
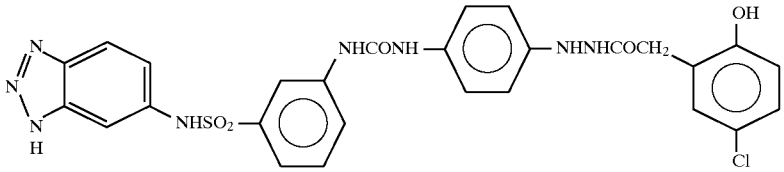
I-16
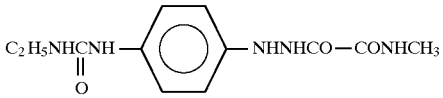
I-17
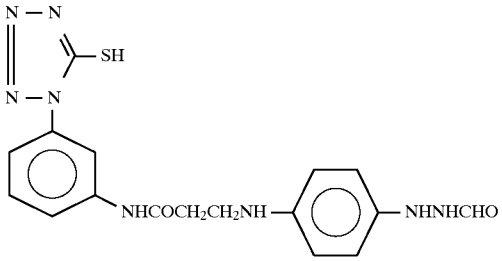
I-18
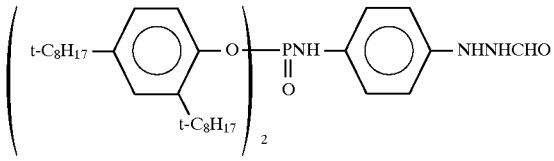
I-19
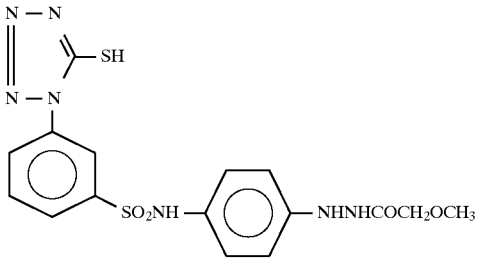

-continued
I-20
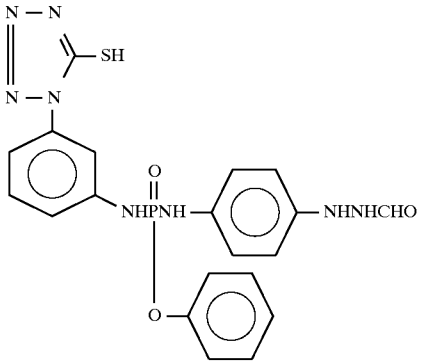
I-21
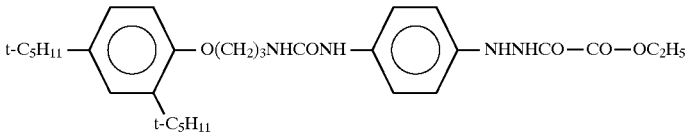
I-22
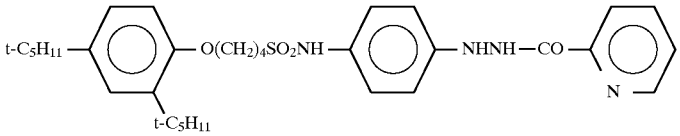
I-23
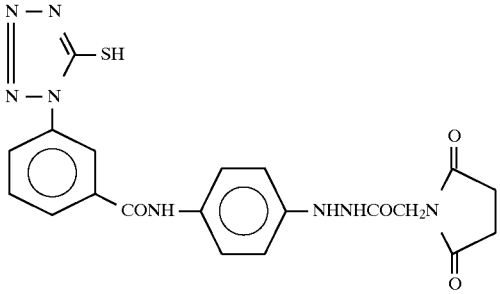
I-24
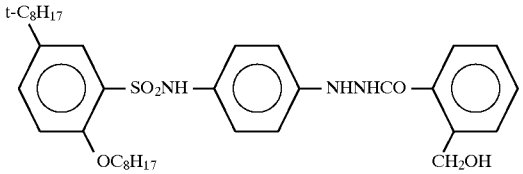
I-25
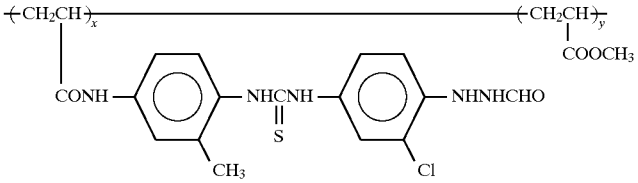
x:y = 3:97, Average Molecular Weight: about 100,000
I-26
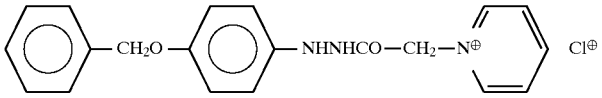
I-27
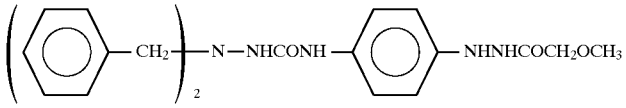

-continued
I-28
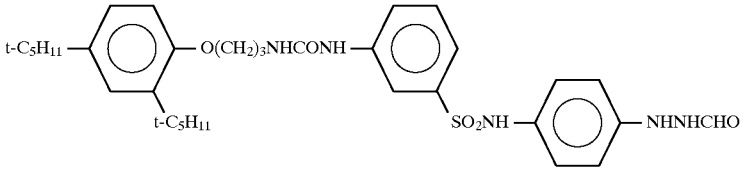
I-29
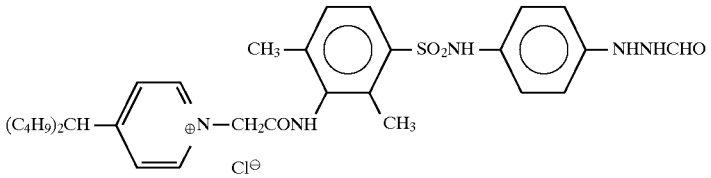
I-30
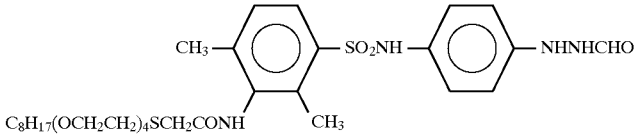
I-31
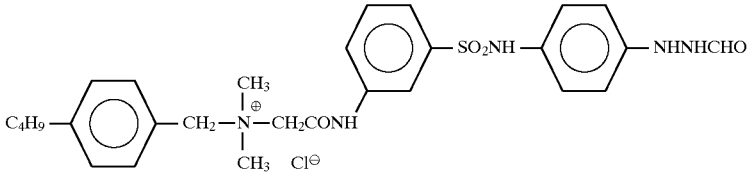
I-32
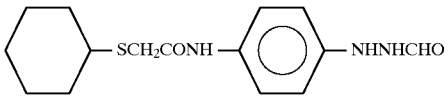
I-33
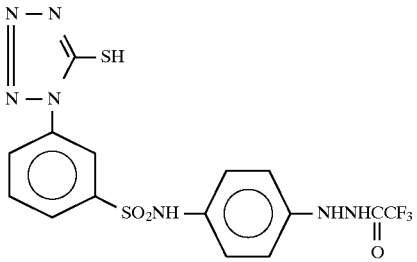
I-34
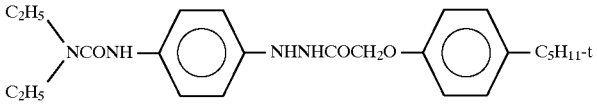
I-35
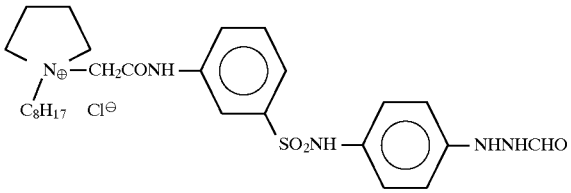
I-36
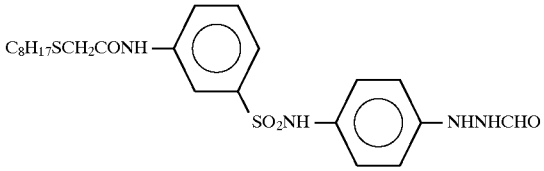

-continued
I-37
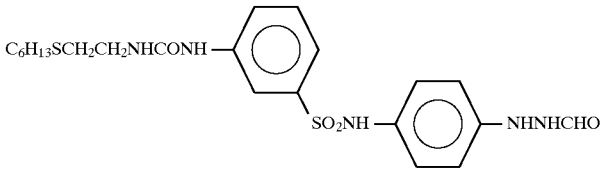
I-38
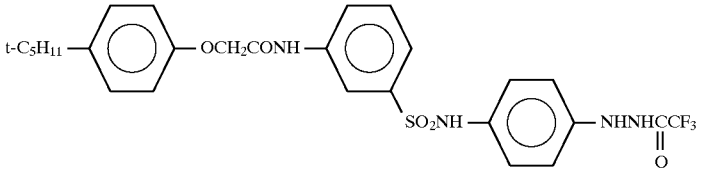
I-39
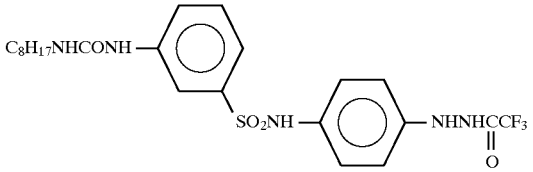
I-40
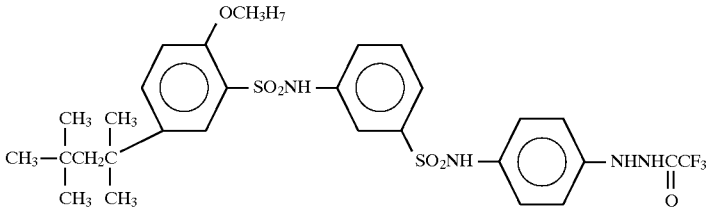
I-41
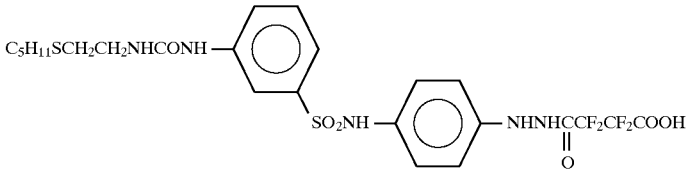
I-42
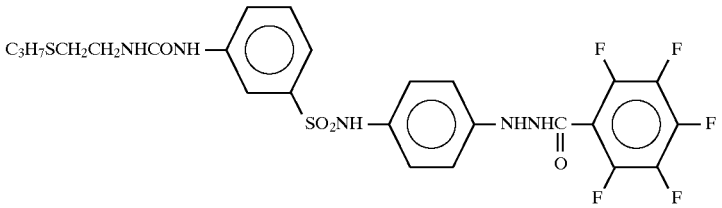
I-43
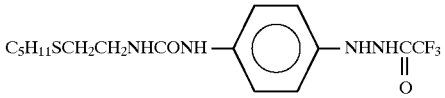
I-44
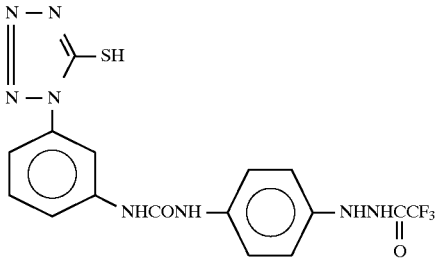

-continued

I-45

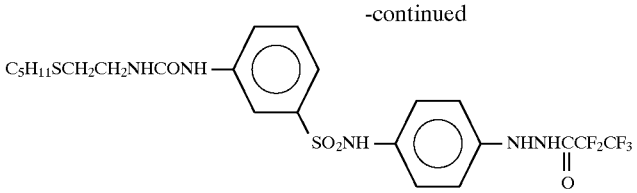

I-46

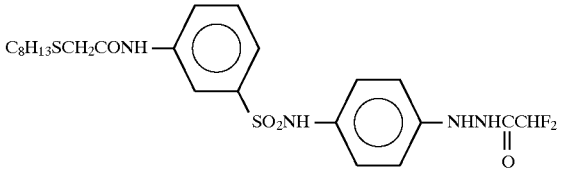

I-47

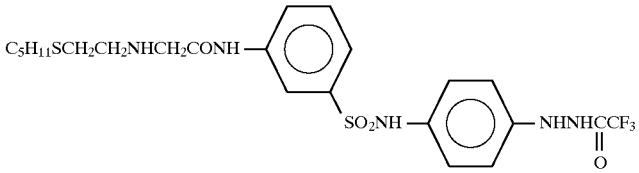

I-48

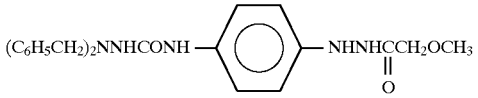

I-49

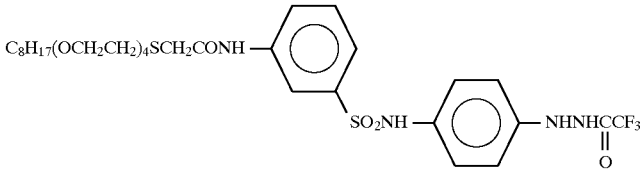

I-50

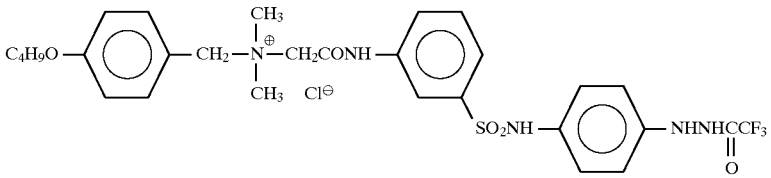

I-51

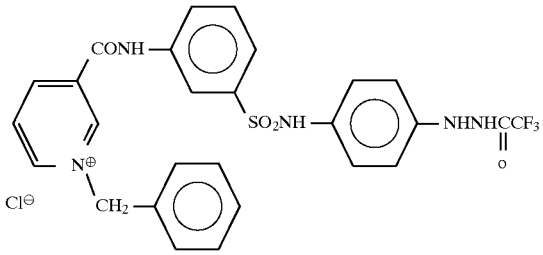

I-52

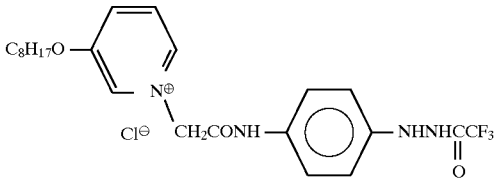

In addition to the above-mentioned hydrazine derivatives, examples of other hydrazine derivatives used in the present invention include those which are described in *Research Disclosure*, Item 23516 (p.346, November, 1983) and the literature quoted therein, U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355, and 5,104,769, British Patent 2,011,391B, European Patents 217,310, 301,799, 356,898, JP-A-60-179734, JP-A-61-170733, JP-A-61-270744, JP-A-62-178246, JP-A-62-270948, JP-A-63-29751, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-64-10233, JP-A-1-90439, JP-A-100530, JP-A-1-105941, JP-A-1-105943, JP-A-1-276128, JP-A-1-280747,JP-A-1-283548, JP-A-1-283549, JP-A-1-285940, JP-A-2-2541, JP-A-2-77057, JP-A-2-139538, JP-A-2-196234, JP-A-2-196235, JP-A-2-198440, JP-A-2-198441, JP-A-2-198442, JP-A-2-220042, JP-A-2-221953, JP-A-2-221954, JP-A-2-285342, JP-A-2-285343, JP-A-2-289843, JP-A-2-302750, JP-A-2-304550, JP-A-3-37642, JP-A-3-54549, JP-A-3-125134, JP-A-3-184039, JP-A-3-240036, JP-A-3-240037, JP-A-3-259240, JP-A-3-280038, JP-A-3-282536, JP-A-4-51143, JP-A-4-56842, JP-A-4-84134, JP-A-2-230233, JP-A-4-96053, JP-A-4-216544, JP-A-5-45761, JP-A-5-45762, JP-A-5-45763, JP-A-5-45764, JP-A-5-45765, and JP-A-6-289524.

The content of the hydrazine derivative used in the present invention preferably ranges from $1\times10^{-6}$ to $5\times10^{-2}$ mol, and more preferably from $1\times10^{-5}$ to $2\times10^{-2}$ mol per of silver halide.

In order to use the hydrazine derivative of the present invention, it is dissolved in a suitable organic water-miscible solvent which includes, for example, alcohols such as methanol, ethanol, propanol, and fluorinated alcohols, ketones such as acetone and methyl ethyl ketone, dimethylformamide, dimethylsulfoxide, and methyl cellosolve.

Further, according to a method known well as emulsification dispersion, the hydrazine derivative may be dissolved in an oil such as dibutyl phthalate, tricresyl phosphate, glyceryl triacetate, and diethyl phthalate by use of a co-solvent such as ethyl acetate and cyclohexanone followed by preparing a mechanically emulsified dispersion. Furthermore, according to a method known as solid dispersion, a powdered hydrazine derivative may be dispersed in water by use of a ball mill or a colloid mill, or through a ultrasonic wave.

The hydrazine derivative may be contained in finely powdered polymers as described in JP-A-2-948 to use it.

For a silver halide emulsion for the silver halide photographic material of the present invention, silver chlorobromide or silver iodochlorobromide is used, which contain 50 mol % or more, preferably 60 mol % or more, more preferably 70 mol % or more, of silver chloride. The content of silver iodide is 3 mol % or less, and preferably 0.5 mol % or less. Crystal forms of silver halide grains are cube, tetradecahedron, octadhedron, amorphous state, and plate. Although any grain having these forms can be used, grains of the cubic form are preferred. The average size of silver halide is preferably from 0.1 to 0.7 $\mu$m, and more preferably from 0.2 to 0.5 $\mu$m. The silver halide grains preferably have narrow grain size distributions. That is, the coefficient of variation, which is represented by [(standard deviation of grain size)/(average grain size)]×100, is preferably 15% or less and, more preferably 10% or less.

The inside and the surface of a silver halide grain may consist of uniform planes or may consist of planes different from each other, respectively.

The photographic emulsion used in the present invention can be prepared according to methods described in P. Glafkides, *Chimie et Physique Photographique*, Paul Montel Press, 1967; G. F. Dufin, *Photographic Emulsion Chemistry*, The Forcal Press, 1966; and V. L. Zelikman et al., *Making and Coating Photographic Emulsion*, The Forcal Press, 1964.

Any of a single jet method, a double jet method and a combined method of these methods may be used for reacting a soluble silver salt with a soluble halide salt. There can also be used a method for forming grains in the presence of excess silver ion (the so-called reverse mixing method). The so-called controlled double jet method which is a type of the double jet method can also be used, in which pAg of the liquid phase where silver halide is formed is kept constant. It is also preferred to form grains by use of the so-called silver halide solvent such as ammonia, thioethers and tetra-substituted thioureas. The tetra-substituted thiourea compounds described in JP-A-53-82408 and JP-A-55-77737 are more preferably used. Preferred tetra-substituted thiourea compounds are tetramethylthiourea and 1,3-dimethyl-2-imidazolidinethione.

The controlled double jet method and the method for forming grains by use of the silver halide solvent are easy to prepare a silver halide emulsion having a regular crystal form and a narrow grain size distribution, and they are useful means of preparing the silver halide emulsion of the present invention.

To obtain a uniform grain size, it is preferred to change the addition velocity of silver nitrate or alkali halide, depending upon the speed of grain growth as described in British Patent 1,535,016, JP-B-48-36890 (The term "JP-B" as used herein means an "examined Japanese patent publication") and JP-B-52-16364, and to promote the growth by changing the concentration of an aqueous solution within a critical degree of saturation as described in U.S. Pat. No. 4,242,445 and JP-A-55-158124.

In the silver halide photographic material of the present invention, at least one kind of metal selected among rhodium, rhenium, ruthenium, and osmium is contained in the silver halide grains. The metal content is suitably from $1\times10^{-8}$ to $1\times10^{-6}$ mol, and preferably from $5\times10^{-8}$ to $1\times10^{-6}$ mol per mol of silver. These metals may be used as a mixture of two or more kinds thereof. The metals may be contained in the silver halide grains uniformly or with some distribution as described in JP-A-63-29603, JP-A-2-306236, JP-A-3-167545, JP-A-4-76534 and JP-A-6-110146.

Rhodium, rhenium, ruthenium or osmium is added to the silver halide grains in a form of a water-soluble complex salt described in JP-A-63-2042, JP-A-1-285941, JP-A-2-20852, JP-A-2-20855, and so forth. Particularly preferred complexes are those which have a coordination number of six as represented by the following formula:

$$[ML_6]^{-n}$$

wherein M represents rhodium, ruthenium, rhenium, or osmium; L represents a ligand; and n represents 0, 1, 2, 3, or 4.

Although the counter ion has no important meaning in this case, an ammonium or alkali metal ion is usually used.

Examples of preferred ligands include halide, cyanide, cyanate, nitrosyl, thionitrosyl, aquo, and so forth.

To achieve high sensitivity and high contrast, an iridium compound is preferably added to the silver halide photographic material of the present invention.

Although various iridium compounds can be used in the present invention, examples thereof include hexachloroiridium, hexaammineiridium, trioxalatoiridium, and hexacyano-iridium. These iridium compounds are used as an solution in water or a suitable solvent. Further, to stabilize the iridium solution, an aqueous solution of hydrogen halide (for example, hydrogen chloride, hydrogen bromide, hydrogen fluoride) or alkali halide (for example, potassium chloride, sodium chloride, potassium bromide, sodium bromide) can be generally added thereto. In place of the water-soluble iridium compounds, other silver halide grains doped previously with iridium may be added and dissolved to prepare the silver halide.

In the present invention, the total content of the iridium compounds is preferably from $1\times10^{-8}$ to $5\times10^{-6}$ mol, and more preferably from $5\times10^{-8}$ to $1\times10^{-6}$ mol per mol of silver halide formed finally.

Although the addition of the iridium compounds may be suitably carried out either at the step of preparing the silver halide emulsion grains or prior to the step of applying the emulsion, it is particularly preferred to add the iridium compounds on forming the emulsion to incorporate them into the silver halide grains.

The silver halide grains used in the present invention may contain a metallic atom such as iron, cobalt, nickel, ruthenium, palladium, platinum, gold, thallium, copper, and lead. The content of these metallic atoms is preferably from $1\times10^{-9}$ to $1\times10^{-4}$ mol per mol of silver halide. The metallic atoms can be added as single salts, double salts, or complex salts on forming the silver halide grains.

The silver halide emulsion of the present invention are preferably subjected to chemical sensitization. Known chemical sensitization such as sulfur sensitization, selenium sensitization, tellurium sensitization, and noble metal sensitization can be carried out, singly or in a combination thereof. Examples of preferred combinations thereof include a combination of sulfur sensitization and gold sensitization, a combination of sulfur sensitization, selenium sensitization and gold sensitization, and a combination of sulfur sensitization, tellurium sensitization and gold sensitization.

The sulfur sensitization in the present invention is usually carried out by adding a sulfur sensitizer to an emulsion and stirring at a high temperature of 40° C. or higher for a certain period of time. The sulfur sensitizers used are known compounds which include various sulfur compounds such as thiosulfates, thioureas, thiazoles, and rhodanines, as well as sulfur compounds contained in gelatin. Preferred sulfur compounds are thiosulfates and thiourea compounds. Although the content of the sulfur sensitizers varies with various conditions such as pH and temperature on chemical ripening and grain size, it is generally from $10^{-7}$ to $10^{-2}$ mol, and more preferably from $10^{-5}$ to $10^{-3}$ mol per mol of silver halide.

The selenium sensitizers used in the present invention are known selenium compounds. The selenium sensitization is usually carried out by adding selenium compounds of unstable and/or non-stable types to the emulsion and stirring at a high temperature of 40° C. or higher for a certain period of time. The selenium compounds of a unstable type are described in JP-B-44-15748, JP-B-43-13489, JP-A-4-109240, JP-A-4-324855, and so forth. Compounds represented by general formulas (VIII) and (IX) of JP-A-4-324855 are particularly preferred.

The tellurium sensitizers used in the present invention form silver telluride which is considered to be sensitization nuclei on the surface or the inside of silver halide grains. The formation speed of silver telluride in a silver halide emulsion can be examined according to a method described in JP-A-5-313284. Examples of the tellurium sensitizers which can be used in the present invention are described in U.S. Pat. Nos. 1,623,499, 3,320,069 and 3,772,031, British Patents 235,211, 1,121,496, 1,295,462, and 1,396,696, Canadian Patent 800,958, JP-A-4-204640, JP-A-4-271341, JP-A-4-333043 and JP-A-5-303157, *J. Chem. Soc., Chem. Commun.,* 635 (1980), ibid., 1102 (1979), ibid., 645 (1979), *J. Chem. Soc., Perkin Trans.,* 1, 2191 (1980), *The Chemistry of Organic Selenium and Tellurium Compounds*, edited by S. Patai, Vol. 1 (1986) and Vol. 2 (1987). Compounds represented by general formulas (II), (III) and (IV) of JP-A-5-313284 are particularly preferred.

The content of the selenium or tellurium sensitizers used in the present invention varies depending upon silver halide grains used, conditions of chemical ripening, and so forth. However, it is generally from about $10^{-8}$ to about $10^{-2}$ mol, and preferably from about $10^{-7}$ to about $10^{-3}$ per mol of silver halide. Although conditions of chemical ripening are not particularly limited, pH is generally from 5 to 8; pAg is from 6 to 11, and more preferably from 7 to 10; the temperature is from 40° to 95° C., and more preferably from 45° to 85° C.

The noble metal sensitizers used in the present invention include gold, platinum, palladium, and iridium. Gold sensitization is particularly preferred among these. Examples of the gold sensitizers used include chloroauric acid, potassium chloroaurate, potassium aurithiocyanate, and gold sulfide. The content of the gold sensitizers is from about $10^{-7}$ to about $10^{-2}$ mol per mol of silver halide.

In the silver halide emulsion used in the present invention, cadmium salts, sulfites, lead salts, or thallium salts may be allowed to coexist in the process of the formation or physical ripening of silver halide grains.

In the present invention, reduction sensitization can be carried out. The reduction sensitizers used are stannous salts, amines, formamidinesulfinic acid, silane compounds, and so forth.

Thiosulfonic acid compounds may be added to the silver halide emulsion of the present invention according to a method described in European Patent Publication No. 293,917.

In the present invention, silver halide emulsions, which are different from one another in average grain size, composition of halide, crystal habit, or conditions of chemical sensitization, may be used singly or as a mixture of two or more kinds thereof.

It is preferred that the silver halide photographic material of the present invention contains nucleating accelerators represented by general formulas (II) to (IV) described in Japanese Patent Application No. 6-288688. Examples of the nucleating accelerators are as follows:

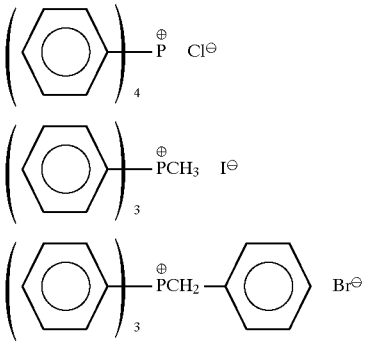

A-1

A-2

A-3

-continued
A-4
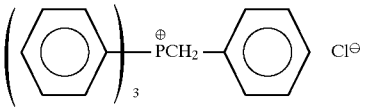
A-5
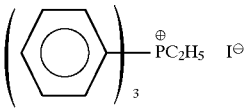
A-6
$(n\text{-}C_4H_9)_4\overset{\oplus}{P}$ $Br^{\ominus}$
A-7
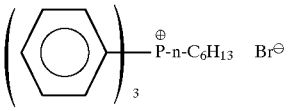
A-8
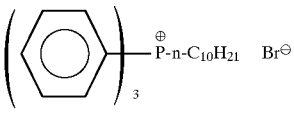
A-9
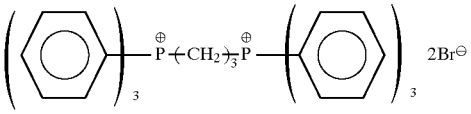
A-10
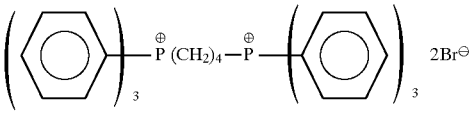
A-11
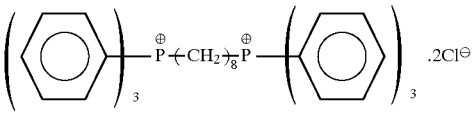
A-12
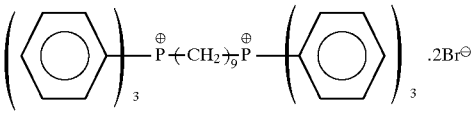
A-13
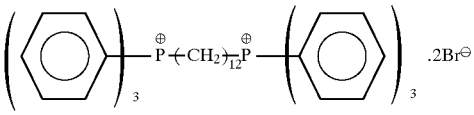
A-14
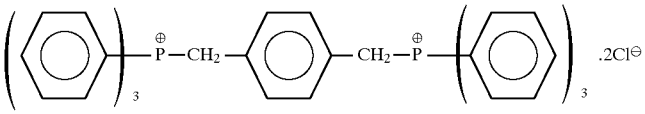
B-1
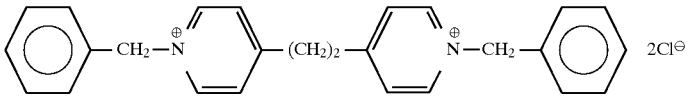
B-2
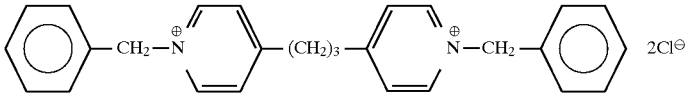
B-3
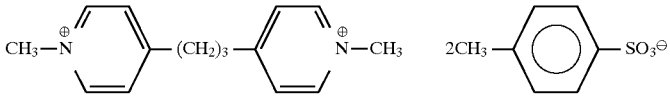
B-4
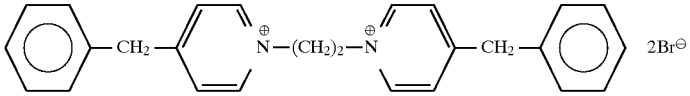

-continued
B-5
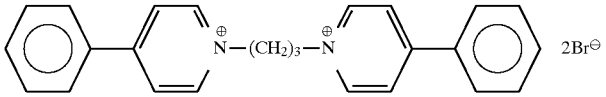
B-6
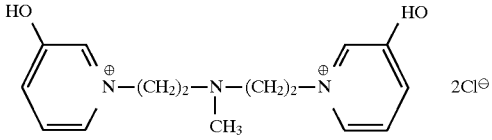
B-7
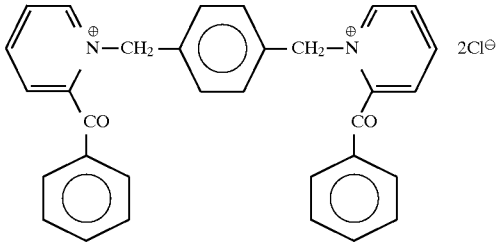
C-1
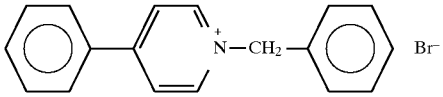
C-2
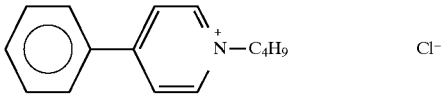
C-3
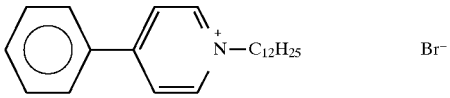
C-4
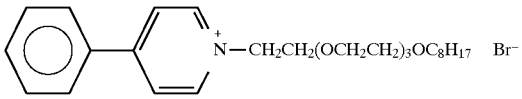
C-5
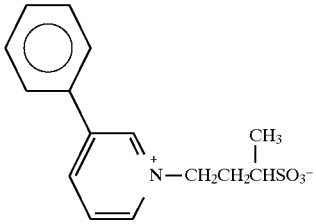
C-6
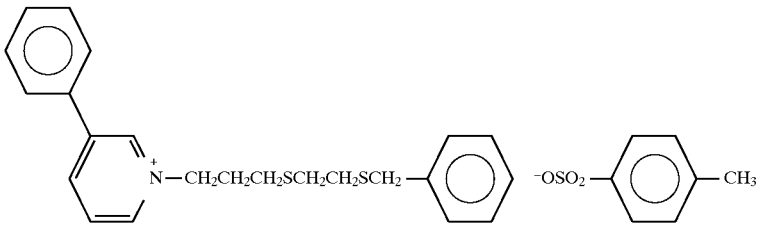
D-1
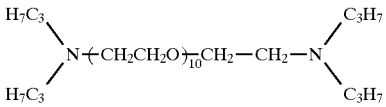
D-2
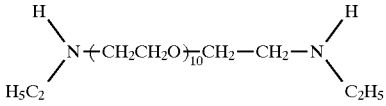

-continued
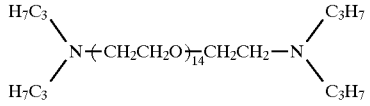
D-3
Infrared sensitizing dyes which are preferably used in the present invention include dyes described in JP-A-60-80841, JP-A-62-299838 and JP-A-62-299839, dye represented by general formulas (IVa) and (IVb) described in JP-A-2-113238, and dyes represented by general formulas (IIIa) and (IIIb) described in JP-A-2-184841. Concrete examples thereof are as follows:
IR-1
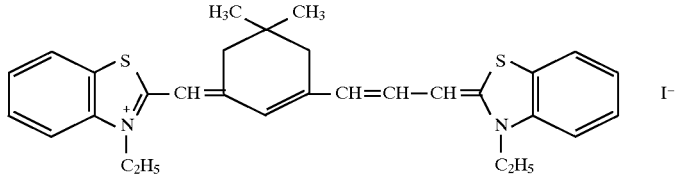
IR-2
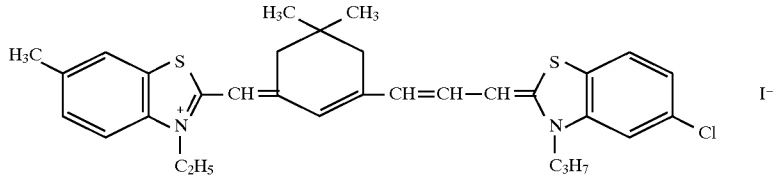
IR-3
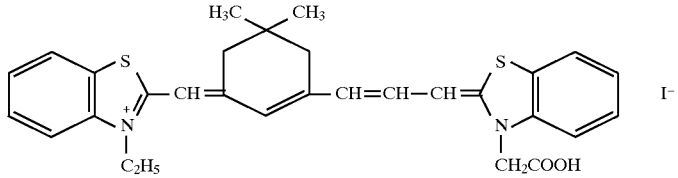
IR-4
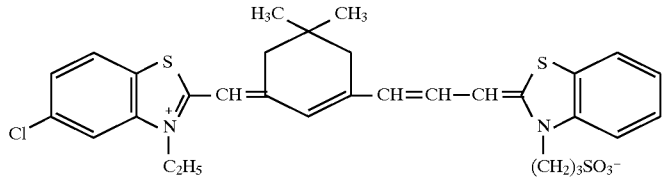
IR-5
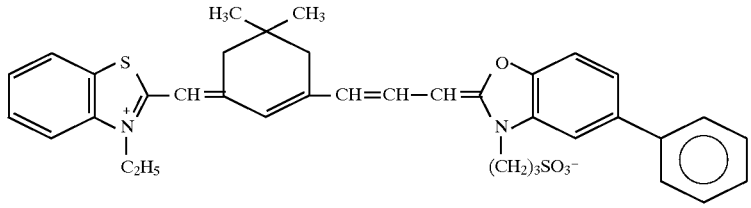
IR-6
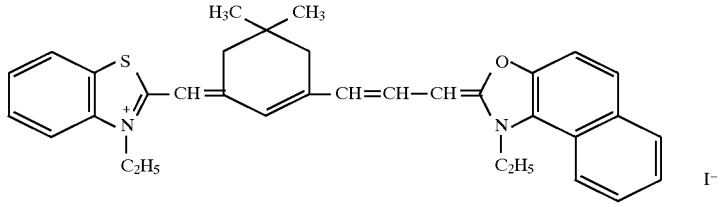
IR-7
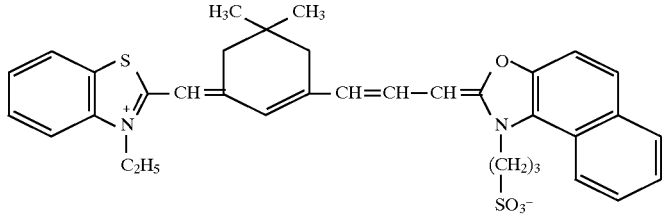

-continued
IR-8
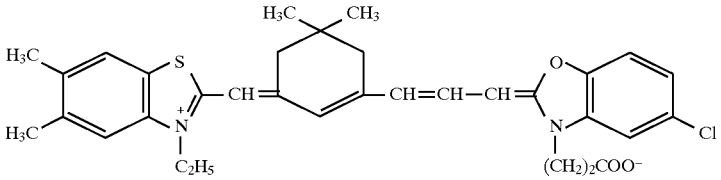
IR-9
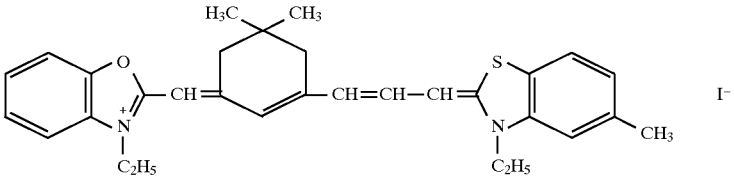
IR-10
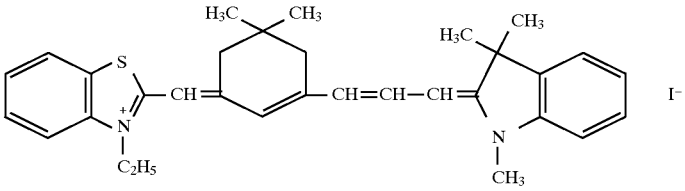
IR-11
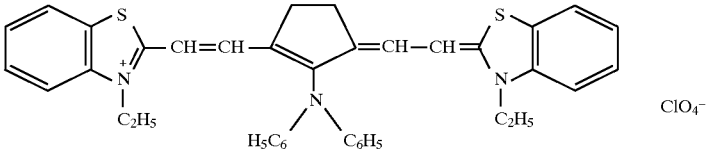
IR-12
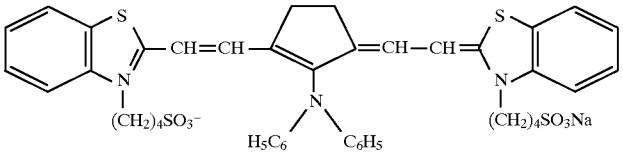
IR-13
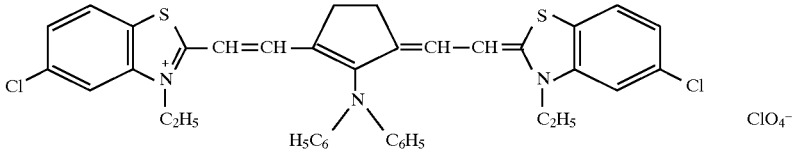
IR-14
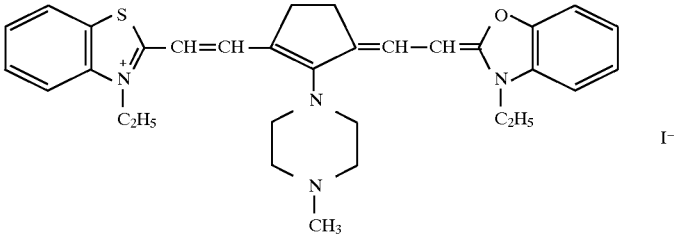
IR-15
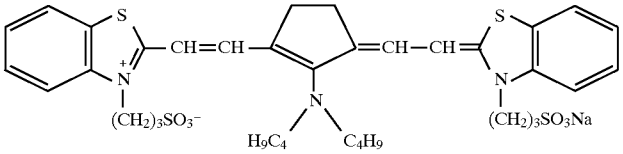

-continued
IR-16
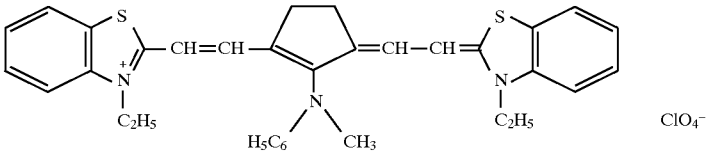
IR-17
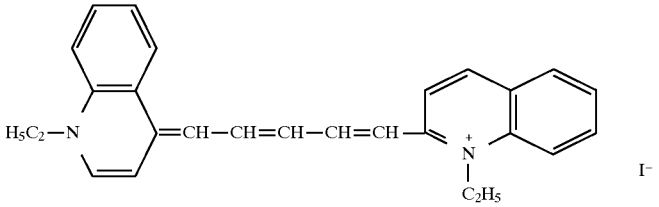
IR-18
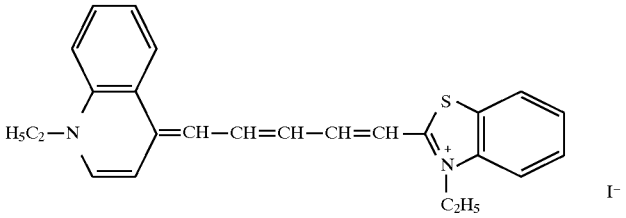
IR-19
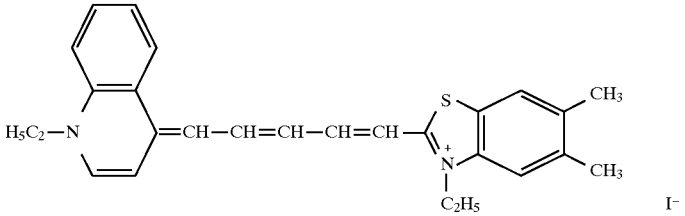
IR-20
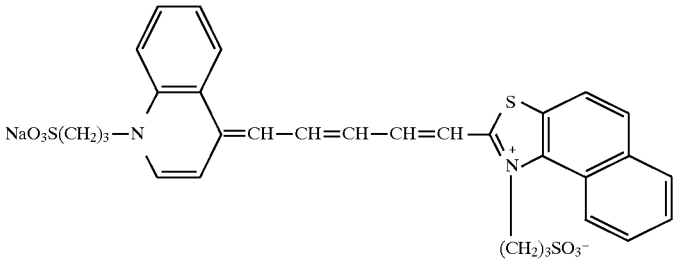
IR-21
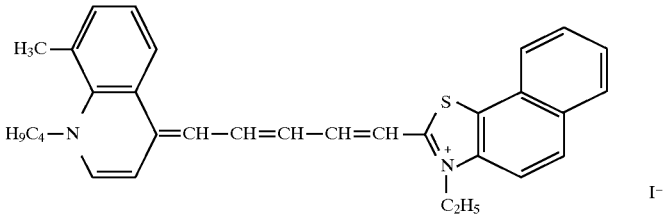
IR-22
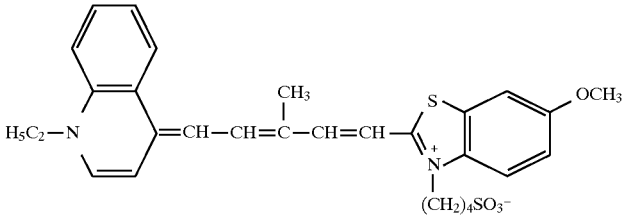

-continued

IR-23

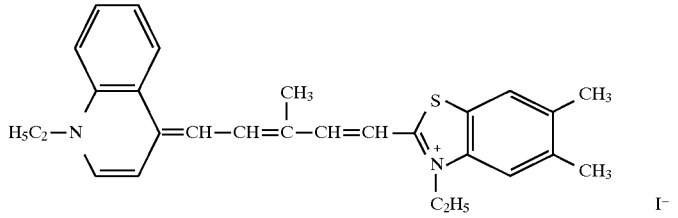

IR-24

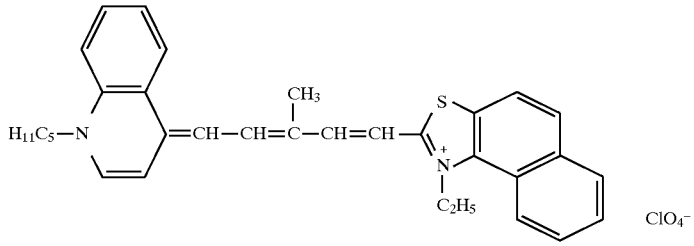

In the present invention, the content of these infrared sensitizing dyes in the silver halide photographic emulsion is from $5\times10^{-7}$ to $5\times10^{-3}$ mol, preferably from $1\times10^{-6}$ to $1\times10^{-3}$ mol, and particularly preferably from $2\times10^{-6}$ to $5\times10^{-4}$ mol, per mol of silver halide.

The above-mentioned infrared sensitizing dyes used in the present invention can be directly dispersed into an emulsion. The dyes can also be first dissolved in a suitable solvent such as methyl alcohol, ethyl alcohol, methyl cellosolve, acetone, water, pyridine, and mixtures thereof followed by adding the resulting solution to an emulsion. Further, they can be dissolved through a ultrasonic wave. In addition, to add the infrared sensitizing dyes to an emulsion, the following methods can also be used: a method that the dye is dissolved in an organic volatile solvent, the resulting solution is dispersed into a hydrophilic colloid, and the dispersion is added to an emulsion as described in U.S. Pat. No. 3,469,987; a method that the water-insoluble dye is dispersed into a water-soluble solvent without dissolving and the dispersion is added to an emulsion as described in JP-B-46-24185; a method that the dye is dissolved in a surfactant and the resulting solution is added to an emulsion as described in U.S. Pat. No. 3,822,135; a method that the dye is dissolved by use of a compound bringing about a red shift and the resulting solution is added to an emulsion as described in JP-A-51-74624; and a method that the dye is dissolved in an acid which does not substantially contain water and the resulting solution is added to an emulsion as described in JP-A-50-80826. In addition, methods described in U.S. Pat. Nos. 2,912,343, 3,342,605, 2,996,287, and 3,429,835 can also be used to add the infrared sensitizing dyes to an emulsion. The infrared sensitizing dyes represented by general formulas (IVa) and (IVb) described in JP-A-2-113238 which are preferably used in the present invention may be uniformly dispersed into a silver halide emulsion prior to applying to a suitable support. Of course, they can be dispersed in any of steps of preparing the silver halide emulsion.

The sensitizing dyes of the present invention can be further used in combinations with other sensitizing dyes. Examples of those sensitizing dyes are described in U.S. Pat. Nos. 3,703,377, 2,688,545, 3,397,060, 3,615,635, and 3,628,964, British Patents 1,242,588 and 1,293,862, JP-B-43-4936, JP-B-44-14030, JP-B-43-10773, U.S. Pat. No. 3,416,927, JP-B-43-4930, U.S. Pat. Nos. 3,615,613, 3,615,632, 3,617,295, and 3,635,721.

To increase the effect of infrared spectral sensitization or to improve keeping quality, it is preferred to add compounds represented by general formulas (III) and (IV) described in JP-A-60-80841 to the photographic material of the present invention.

The content of the compounds represented by general formulas (III) and (IV) is preferably from about 0.01 to 5 g per mol of silver halide in the emulsion. These compounds can be directly dispersed into the emulsion, or they can also be dissolved in a suitable solvent such as water, methyl alcohol, ethyl alcohol, propanol, methyl cellosolve, acetone or a mixed solvent consisting of a plurality of these solvents and the resulting solution can be then added to the emulsion. In addition, in accordance with general methods for adding the sensitizing dyes, they can be added to the emulsion in a form of a solution or a dispersion into colloid.

In order to improve image quality, antihalation dyes or irradiation preventing dyes are preferably added to the photographic material of the present invention. Preferred dyes are ones represented by general formulas (Va) to (Vd) described in JP-A-60-80841.

Examples of the dyes represented by the above-mentioned general formulas (Va) to (Vd) include, in addition to dyes cited therein, dyes described in JP-A-62-3250, JP-A-61-174540 and JP-A-62-123454. These dyes may be used singly or as a mixture of two or more kinds thereof.

These dyes are added to a backing layer to an extent that the transmission optical density in 740 to 840 nm becomes 0.6 or more. Although the concrete amount of the dyes varies with kinds thereof, preferred amount thereof is generally found in the range of $10^{-3}$ to 1 g/m$^2$, and particularly, in the range of $10^{-3}$ to 0.5 g/m$^2$.

Various additives of other types than those described above can be used for the photographic material of the present invention without any exception. For example, additives described in the following portions can be preferably used.

| Item | Corresponding Portion |
|---|---|
| 1. Hydrazine Nucleating Agents | JP-A-2-12236, page 2, upper right column, line 19 to page 7, upper right column, line 3; JP-A-3-174143, page 20, lower right column, line 1 to page 27, upper right column, line 20, general formula (II) and compounds II-1 to II-54 |

-continued

| Item | Corresponding Portion |
|---|---|
| 2. Nucleating Accelerators | JP-A-2-103536, page 9, upper right column, line 13 to page 16, upper left column, line 10, general formulas (II-m) to (II-p) and compounds II-1 to II-22; compounds described in JP-A-1-179939 |
| 3. Silver Halide Emulsions and Processes for the Preparation Thereof | JP-A-2-97937, page 20, lower right column, line 12 to page 21, lower left column, line 14; JP-A-2-12236, page 7, upper right column, line 19 to page 8, lower left column, line 12; and process for selenium sensitization described in JP-A-5-11389 |
| 4. Spectral Sensitizing Dyes | JP-A-2-12236, page 8, lower left column, line 13 to lower right column, line 4; JP-A-2-103536, page 16, lower right column, line 3 to page 17, lower left column, line 20; and spectral sensitizing dyes described in JP-A-1-112235, JP-A-2-124560, JP-A-3-7928 and JP-A-5-11389 |
| 5. Surfactants | JP-A-2-12236, page 9, upper right column, line 7 to lower right column, line 7; JP-A-2-18542, page 2, lower left column, line 13 to page 4, lower right column, line 18 |
| 6. Antifoggants | JP-A-2-103536, page 17, lower right column, line 19 to page 18, upper right column, line 4 and lower right column, line 1 to line 5; and thiosulfinic acid compounds described in JP-A-1-237538 |
| 7. Polymer Latexes | JP-A-2-103536, page 18, lower left column, line 12 to line 20 |
| 8. Acid Group-Containing Compounds | JP-A-2-103536, page 18, lower right column, line 6 to page 19, upper left column, line 1 |
| 9. Matting Agents, Lubricants, and Plasticizers | JP-A-2-103536, page 19, upper left column, line 15 to page 19, upper right column, line 15 |
| 10. Hardeners | JP-A-2-103536, page 18, upper right column, line 5 to line 17 |
| 11. Dyes | JP-A-2-103536, page 17, lower right column, line 1 to line 18; solid dyes described in JP-A-2-294638 and JP-A-5-11382 |
| 12. Binders | JP-2-18542, page 3, lower right column, line 1 to line 2 |
| 13. Black Pepper Inhibitors | compounds described in U.S. Pat. No. 4,956,257 and JP-A-1-118832 |
| 14. Redox Compounds | compounds represented by general formula (I) of JP-A-2-301743 (particularly compound example 1 to 50); general formulas (R-1), (R-2) and (R-3), compound examples 1 to 75 described in pages 3 to 20 of JP-A-3-174143; and compounds described in JP-A-5-257239 |
| 15. Monomethine Compounds | compounds represented by general formula (II) in JP-A-2-287532 (particularly, compounds II-1 to II-26) |
| 16. Dihydroxybenzenes | JP-A-3-39948, page 11, upper left column to page 12, lower left column; and compounds described in European Patent 452,772A |

The developer used for the present invention is described below. As described above, the developer of the present invention does not substantially contain a developing agent of a dihydroxybenzene type and contains a compound represented by general formula (II) as a main developing agent. Auxiliary developing agents of a 1-phenyl-3-pyrazolidone type and/or a p-aminophenol type may be preferably contained in the developer of the present invention.

The compounds represented by general formula (II) which are the developing agents of the present invention are described in detail below.

In general formula (II), $R_{11}$, and $R_{12}$ each represents a hydroxyl group, an amino group which may contain an alkyl group having 1 to 10 carbon atoms as a substituent group (for example, methyl, ethyl, n-butyl, and hydroxyethyl), an acylamino group (for example, acetylamino and benzoylamino), an alkylsulfonylamino group (for example, methanesulfonylamino), an arylsulfonylamino group (for example, benzenesulfonylamino and p-toluenesulfonylamino), an alkoxycarbonylamino group (for example, methoxycarbonylamino), a mercapto group, or an alkylthio group (for example, methylthio and ethylthio). Examples of preferred groups as $R_{11}$ and $R_{12}$ include a hydroxy group, an amino group, an alkylsulfonylamino group and an arylsulfonylamino group.

P and Q each represents a hydroxyl group, a hydroxyalkyl group, a carboxyl group, a carboxyalkyl group, a sulfo group, a sulfoalkyl group, an amino group, an aminoalkyl group, an alkyl group, an alkoxyl group, or an aryl group. Further, P and Q may combine with each other to form one of 5- to 8-membered rings together with two vinyl carbon atoms to which $R_{11}$ and $R_{12}$ attach and with a carbon atom to which Y attaches. The ring structures may be constituted by combinations of, for example, —O—, —C($R_4$)($R_5$)—, —C($R_6$)═, —C(═O)—, —N($R_7$)— and —N═. $R_4$, $R_5$, $R_6$, and $R_7$ each represents a hydrogen atom, an alkyl group having 1 to 10 carbon atoms which may contain a substituent group such as a hydroxyl group, a carboxyl group and a sulfo group, a hydroxyl group, or a carboxyl group. These 5- to 8-membered rings may be fused by a saturated or unsaturated ring.

Examples of these 5- to 8-membered rings include a dihydrofuranone ring, a dihydropyrone ring, a pyranone ring, a cyclopentenone ring, a cyclohexenone ring, a pyrrolinone ring, a pyrazolinone ring, a pyridone ring, an azacyclohexenone ring, and a uracil ring. Among these, preferred rings are a dihydrofuranone ring, a cyclopentenone ring, a cyclohexenone ring, a pyrazolinone ring, an azacyclohexenone ring, and a uracil ring.

Y is constituted of ═O or ↑N—$R_{13}$. $R_{13}$ represents a hydrogen atom, a hydroxyl group, an alkyl group (for example, methyl and ethyl), an acyl group (for example, acetyl), a hydroxyalkyl group (for example, hydroxymethyl and hydroxyethyl), a sulfoalkyl group (for example, sulfomethyl and sulfoethyl), or a carboxyalkyl group (for example, carboxymethyl and carboxyethyl).

Examples of the compounds represented by general formula (II) are shown below. In the present invention, the compounds represented by general formula (II) should not be construed as limiting to the examples shown below.

II-1

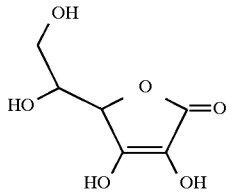

II-2

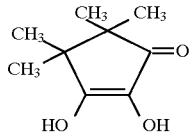

-continued
II-3
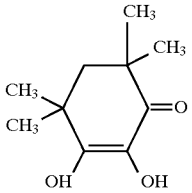
II-4
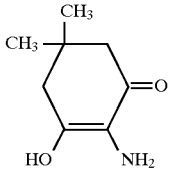
II-5
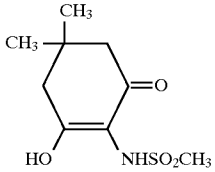
II-6
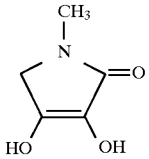
II-7
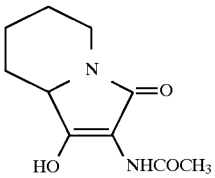
II-8
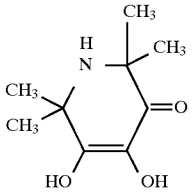
II-9
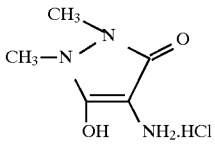
II-10
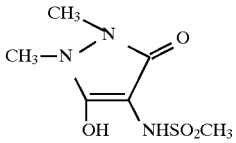
II-11
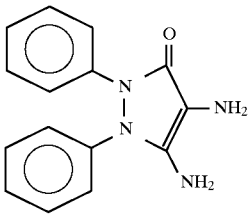
-continued
II-12
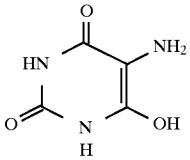
II-13
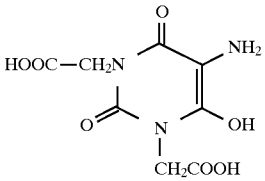
II-14
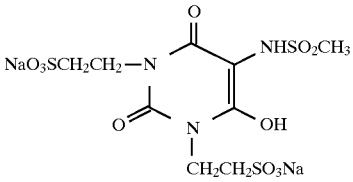
II-15
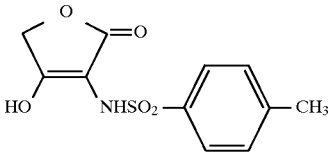
II-16
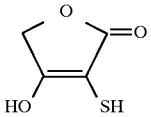
II-17
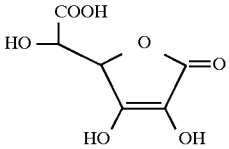
II-18
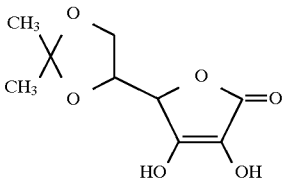
II-19
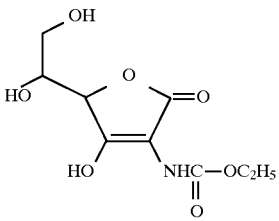
II-20
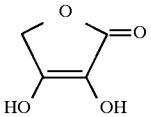

-continued

II-21

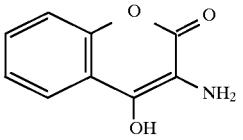

II-22

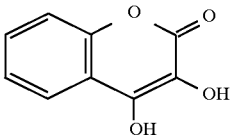

II-23

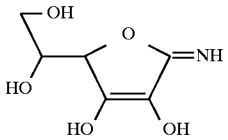

II-24

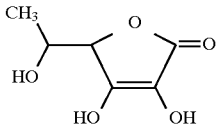

II-25

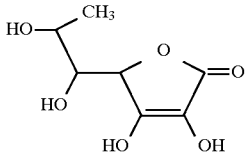

II-26

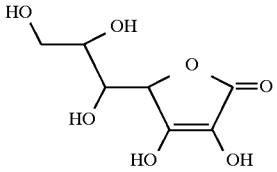

II-27

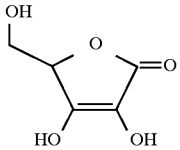

II-28

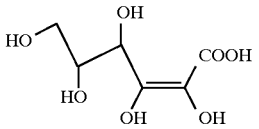

II-29

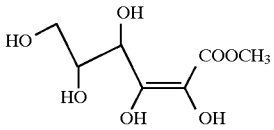

II-30

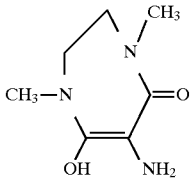

-continued

II-31

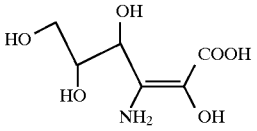

Among these, preferred compounds are ascorbic acid and erythorbic acid (an enantiomer of ascorbic acid)), as well as alkali metal salts thereof (for example, potassium and sodium).

The content of the compounds represented by general formula (II) generally ranges from $5\times10^{-3}$ to 1 mol, and preferably from $10^{-2}$ to 0.5 mol per liter of the developer.

Examples of 1-phenyl-3-pyrazolidone and its derivatives which are developing agents used in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihyroxymethyl-3-pyrazolidone, 1-5-methyl-3-pyrazolidone, 1-p-aminophenyl-4,4-dimethyl-3-pyrazolidone, 1-p-tolyl-4,4-dimethyl-3-pyrazolidne, and 1-p-tolyl-4-methyl-4-hydroxymethyl-3-pyrazolidone.

Examples of the developing agents of p-aminophenol type used in the present invention include N-methyl-p-aminophenol, p-aminophenol, N-(β-hydroxyethyl)-p-aminophenol, N-(4-hydroxyphenyl)glycine, 2-methyl-p-aminophenol, and p-benzylaminophenol. Among these, N-methyl-p-aminophenol is preferred.

When the compounds represented by general formula (II) are used together with 1-phenyl-3-pyrazolidones or p-aminophenols, the content of the latter developing agents generally ranges from $10^{-3}$ to 0.1 mol/liter, and more preferably from $10^{-3}$ to 0.06 mol/liter.

The developer of the present invention does not substantially contain dihydroxybenzenes. This means that the content of dihydroxybenzenes in the developer is extremely small (for example, $5\times10^{-4}$ mol/liter or less), compared to that of the compounds represented by general formula (II) and that of the above-mentioned auxiliary developing agents. It is preferred that the developer of the present invention does not contain dihydroxybenzenes at all.

Preservatives may be added to the developer of the present invention. Examples of the preservatives include sulfites such as sodium sulfite, potassium sulfite, lithium sulfite, sodium bisulfite, potassium metabisulfite, and sodium formaldehydebisulfite. Although the content of the sulfites in the developer is 0.01 mol/liter or more, the sulfites should be used in an amount as small as possible, because use of too much sulfites dissolves silver halide grains to cause silver stain and also to cause COD (chemical oxygen demand) to increase.

The developer used for processing in the present invention is preferably adjusted to pH 9.5 to 11.0, and more preferably to pH 9.7 to 10.7. A developer of pH 11.0 or more has deteriorated stability to air oxidation, and that of pH 9.5 or less is difficult to obtain sufficient contrast. To adjust pH, alkali agents such as sodium hydroxide, potassium hydroxide, sodium carbonate, and potassium carbonate are used.

The developer of the present invention may contain pH buffering agents such as saccharides described in JP-A-60-93433 (for example, saccharose), oximes (for example, acetoxime), phenols (for example, 5-sulfosalicylic acid), silicates, sodium tertiary phosphate and potassium tertiary phosphate. The concentration of the buffering agents is preferably 0.3 mol/liter or more. Use of boron compounds such as boric acid and sodium metaborate is not preferred, because the boron compounds may cause the compounds represented by general formula (II) to be inactivated by reacting with each other.

The developer of the present invention may further contain development inhibitors such as potassium bromide and potassium iodide; organic solvents such as ethylene glycol, diethylene glycol, triethylene glycol, dimethylformamide, methyl cellosolve, hexylene glycol, ethanol, and methanol; antifoggants such as indazole type compounds (for example, 5-nitroindazole), benzimidazole type compounds (for example, sodium 2-mercaptobenzimidazole-5-sulfonate), and benztriazole type compounds (for example, 5-methylbenztriazole); development accelerators described in *Research Disclosure,* vol. 176, No. 17643, Item XXI (December, 1978); and amine compounds described in U.S. Pat. No. 4,269,929, JP-A-61-267759, and JP-A-2-208652. Furthermore, the developer may contain toning agents, surfactants, and hardeners, as needed.

Fixer is an aqueous solution of a fixing agent which further contains a hardener (for example, water-soluble aluminum compounds), acetic acid and a dibasic acid (for example, tartaric acid, citric acid, and their salts) as needed, and preferably has pH of 3.8 or more, and more preferably pH of 4.0 to 5.5. The fixing agents are sodium thiosulfate, ammonium thiosulfate, and so forth. Although the content of the fixing agents can be suitably changed, it is generally from about 0.1 to about 5 mol/liter.

Water-soluble aluminum salts which are mainly used as a hardener in the fixer are generally known as a hardener for an acid hardening fixer, examples of the salts including aluminum chloride, aluminum sulfate and potash alum.

As the above-mentioned dibasic acids, tartaric acid and its derivatives and citric acid and its derivatives can be used singly or as a mixture of two or more kinds thereof. The content of these compounds in the fixer is effectively 0.005 mol or more, and particularly effectively is from 0.01 to 0.03 mol per liter of the fixer. Examples of tartaric acid and its derivatives include tartaric acid, potassium tartrate, sodium tartrate, potassium sodium tartrate, ammonium tartrate, and potassium ammonium tartrate. Citric acid and its derivatives used effectively in the present invention are, for example, citric acid, sodium citrate, and potassium citrate.

The fixer may further contain, if desired, preservatives (for example, sulfites and bisulfites), pH buffering agents (for example, acetic acid and boric acid), pH adjusters (for example, ammonia and sulfuric acid), image storage improvers (for example, potassium iodide), and chelating agents. The content of the pH buffering agents in the fixer is from 10 to 40 g/liter, and more preferably from 18 to 25 g/liter, because of high pH of the developer.

Fixing accelerators which may be used in the present invention are, for example, thiourea derivatives described in JP-A-45-35754, JP-A-58-122535 and JP-A-58-122536; alcohols containing a triple bond in molecule: thioether compounds described in U.S. Pat. No. 4,126,459; and further, compounds described in JP-A-2-44355.

Compounds described in JP-A-64-4739 can be further used as a dye elution accelerator.

The photographic material of the present invention exhibits excellent performance in rapid processing by use of an automatic processor in which total processing time is 20 to 60 sec. In the rapid processing of the present invention, the development and fixation are conducted at about 25° to about 50° C. for 25 sec or less, and preferably at 30° to 40° C. for 6 to 15 sec, respectively.

The photographic material of the present invention is subjected to washing or stabilization processing after development and fixation. To the washing process, a 2 or 3 stage-countercurrent washing system can be adopted to save water. To wash with a small amount of water, a squeegee roller wash tank is preferably provided. Further, part or all of the overflowed liquid from a washing bath or a stabilizing bath can also be recycled to be supplied to the fixer as described in JP-60-235133, which preferably decreases the amount of waste solution.

Washing water may contain an antifungal agent [for example, compounds described in Horiguchi, *Bohkin Bohbai no Kagaku* (*Chemistry of Bacteria Prevention and Fungus Prevention*), and JP-A-62-115154], a washing accelerator (for example, sulfites), and a chelating agent.

Treatment in the washing bath or in the stabilizing bath is carried out at 0° to 50° C. for 5 to 30 sec, and preferably at 15° to 40° C. for 5 to 20 sec.

After development, fixation and drying, the photosensitive material of the present invention is allowed to pass through a squeegee roller, and then dried. Drying is conducted at 40° to 80° C. for 5 to 30 sec.

The total processing time of the present invention means a total time which is required starting with the edge of a film to be put into an insertion aperture of an automatic processor till the edge of the film appears from the outlet thereof. In that period, the film is allowed to pass through a development tank, a juncture, a fixing tank, a juncture, a wash tank, a juncture, and a drying oven in sequence.

The present invention is illustrated by means of the following examples below. However, the present invention should not be construed as limiting to these examples.

EXAMPLE 1

Developers containing the compounds represented by general formula (II) of the present invention were prepared according to the formulations shown in Table 1. Developers containing hydroquinone as a developing agent are also simultaneously prepared as comparative examples.

TABLE 1

(Composition of Developers)

| Component of Developer | Composition D-1 | D-2 | D-3 | D-4 | D-5 | D-6 | D-7 |
|---|---|---|---|---|---|---|---|
| Sodium Hydroxide (g) | 10 | 10 | 15 | 15 | 15 | 15 | 15 |
| Diethylenetriamine-pentaacetic Acid (g) | 1.5 | 1.5 | 1.5 | 1.5 | 1.5 | 1.5 | 1.5 |
| Potassium Carbonate (g) | 15 | 15 | 15 | 15 | 15 | 15 | 15 |
| Potassium Bromide (g) | 3 | 3 | 3 | 3 | 3 | 3 | 3 |
| 5-Methylbenzotriazole (g) | 0.10 | 0.10 | 0.10 | 0.10 | 0.10 | 0.10 | 0.10 |
| 1-Phenyl-5-mercaptotetrazole (g) | 0.02 | 0.02 | 0.02 | 0.02 | 0.02 | 0.02 | 0.02 |
| Potassium Sulfite (g) | 65 | 65 | 10 | 10 | 10 | 10 | 10 |
| 4-Hydroxymethyl-4-methyl-1-phenyl 3-pyrazolidone (g) | 0.4 | 0.4 | 0.4 | 0.4 | — | 0.4 | 0.4 |
| N-Methyl-p-aminophenol (g) | — | — | — | — | 1.2 | — | — |
| Hydroquinone (g) | 25 | 25 | — | — | — | — | — |
| Compound II-1 of This Invention (g) | — | — | 30 | 30 | 30 | — | — |
| Compound II-3 of This Invention (g) | — | — | — | — | — | 28 | — |
| Compound II-24 of This Invention (g) | — | — | — | — | — | — | 26 |
| Water to make (liter) | 1 | 1 | 1 | 1 | 1 | 1 | 1 |
| pH Adjusted to | 10.7 | 10.0 | 10.0 | 10.7 | 10.7 | 10.7 | 10.7 |
| COD Value | 489 | 494 | 214 | 220 | 223 | 214 | 218 |
| Note | CE*1 | CE | PI*2 | PI | PI | PI | PI |

*1CE: Comparative Example
*2PI: The Present Invention

[Measurement of COD]

Chemical oxygen demand (COD) was measured as to 100-fold diluted solutions of the developers in Table 1 according to Japanese Industrial Standard (JIS) K 0102-18. The result, which is also shown in Table 1, indicates that the developers of the present invention exhibit COD values as low as 1/10 or less, compared to the developers containing customary developing agents of a hydroquinone type. This demonstrates that the developers of the present invention can reduce not only ecological and toxicological hazards, but also environmental pollution due to a waste solution from washing water, the pollution stemming from the components of the developer mingled with an overflowed liquid from the wash tank on processing by use of a customary automatic processor.

EXAMPLE 2

An emulsion was prepared according to the following method.

Emulsion A:

A 0.13M aqueous solution of silver nitrate and an aqueous solution of halide salts which contains $(NH_4)_2Rh(H_2O)Cl_5$ in an amount of $1.5\times10^{-7}$ mol per mol of silver and $K_3IrCl_6$ in an amount of $2\times10^{-7}$ mol per mol of silver, a 0.04M of potassium bromide, and a 0.09M of sodium chloride were added with stirring to an aqueous solution of gelatin containing sodium chloride and 1,3-dimethyl-2-imidazolidinethion at 38° C. for 12 min according to a double jet method. Thus, silver chlorobromide grains which have an average grain size of 0.14 μm which contain 70 mol % of silver chloride were prepared to conduct nucleation. Subsequently, a 0.87M aqueous solution of silver nitrate and an aqueous solution of halide salts containing a 0.26M of potassium bromide and 0.65M of sodium chloride were similarly added over a 20-minute period according to the double jet method.

A $1\times10^{-1}$M solution of potassium iodide was thereafter added to the respective emulsions to conduct conversion. According to an ordinary flocculation method, the emulsions were washed with water, to which gelatin was added in an amount of 40 g per mol of silver and adjusted to pH 6.0 and pAg 7.5; 7 mg of sodium benzenethiosulfonate, 2 mg of benzenesulfinic acid, 8 mg of chloroauric acid, 200 mg of potassium thiocyanate, and 5 mg of sodium thiosulfate were further added, based on 1 mol of silver, while keeping a temperature of 65° C., to conduct chemical sensitization so as to obtain optimum sensitivity; and 150 mg of 4-hydroxy-6-methyl-1,3,3a,7-tetrazaindene as a stabilizer and 100 mg of proxel as a preservative were added to prepare emulsion A of silver chloroiodobromide cubes which have an average size of 0.25 μm and contain 69.9 mol % of silver chloride. Emulsions B to F shown in Table 2 were also prepared in a similar manner, with the proviso that chemical sensitization in emulsions C and D was changed as shown below.

Preparation of Emulsion C:

Emulsion C was prepared in a manner similar to that of emulsion A, except that the chemical sensitization was carried out under conditions of pH 5.9 and pAg 7.5 at 65° C. by use of 2.0 mg of sodium thiosulfate, 3.0 mg of triphosphine selenide, 6 mg of chloroauric acid, 4 mg of sodium benzenethiosulfonate, and 1 mg of sodium benezenesulfinate.

Preparation of Emulsion D:

Emulsion D was prepared in a manner similar to that of emulsion A, except that the chemical sensitization was carried out under conditions of pH 5.9 and pAg 7.5 at 65° C. by use of 2.0 mg of sodium thiosulfate, 3.0 mg of triphosphine telluride, 6 mg of chloroauric acid, 4 mg of sodium benzenethiosulfonate, and 1 mg of sodium benzenesulfinate.

TABLE 2

| | | Rhodium or Ruthenium Complex | | | $K_3IrCl_6$ | | | |
|---|---|---|---|---|---|---|---|---|
| Emulsion | Composition of Halide | Formula | Position of Addition | Content (mol/mol Ag) | Position of Addition | Content (mol/mol Ag) | Chemical Sensitization | Note |
| A | $AgBr_{30}Cl_{69.9}I_{0.1}$ | $(NH_4)_2Rh(H_2O)Cl_5$ | Core | $1.5\times10^{-7}$ | C/S | $2\times10^{-7}$ | Au/S | Present Invention |
| B | $AgBr_{30}Cl_{69.9}I_{0.1}$ | $K_2Ru(NO)Cl_5$ | Core | $1.5\times10^{-7}$ | C/S | $2\times10^{-7}$ | Au/S | Present Invention |
| C | $AgBr_{30}Cl_{69.9}I_{0.1}$ | $(NH_4)_2Rh(H_2O)Cl_5$ | Core | $1.5\times10^{-7}$ | C/S | $2\times10^{-7}$ | Au/S/Se | Present Invention |
| D | $AgBr_{30}Cl_{69.9}I_{0.1}$ | $(NH_4)_2Rh(H_2O)Cl_5$ | Core | $1.5\times10^{-7}$ | C/S | $2\times10^{-7}$ | Au/S/Te | Present Invention |
| E | $AgBr_{60}Cl_{39.9}I_{0.1}$ | $(NH_4)_2Rh(H_2O)Cl_5$ | Core | $1.7\times10^{-7}$ | C/S | $2\times10^{-7}$ | Au/S | Comparative Example |
| F | $AgBr_{30}Cl_{69.9}I_{0.1}$ | — | — | — | C/S | $2\times10^{-7}$ | Au/S | Comparative Example |

Infrared sensitizing dye IR-6 was added in an amount of $1.5\times10^{-3}$ mol per mol of silver to these emulsions to sensitize them in the infrared region. For the purposes of supersensitization and stabilization, $3\times10^{-3}$ mol/molAg of disodium 4,4'-bis(4,6-dinaphthoxypyrimidin-2-ylamino)-stylbenedisulfonate and $4\times10^{-3}$ mol/molAg of 2,5-diemthyl-3-allylbenzothiazole iodide were added to the emulsions. Further, $4\times10^{-4}$ mol/molAg of the mercapto compound represented by (a), $4\times10^{-4}$ mol/molAg of the triazine compound represented by (b), $5\times10^{-4}$ mol/molAg of hydrazine derivative I-37 and $1\times10^{-4}$ mol/molAg of hydrazine derivative I-41 of the present invention, the nucleating accelerator represented by the following formula, 15% by weight of polyethyl acrylate based on gelatin, 15% by weight of a copolymer latex, based on gelatin, (The latex was prepared from n-butyl acrylate, styrene, 2-acetoacetoxyethyl methacrylate, and methacrylic acid in a ratio of 54:20:16:10), 80 mg/m$^2$ of 2-bis(vinylsulfonylacetamido) ethane as a hardener, and 40 mg/m$^2$ of 2,4-dichloro-6-hydroxy-s-triazine were added to the emulsions which were applied to a polyester support having a undercoat layer formed of a vinylidene chloride-based copolymer so that the amount of silver was 3.0 g/m$^2$. The amount of gelatin was 1.5 g/m$^2$.

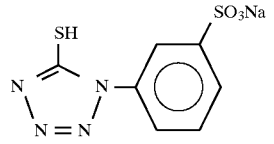

(a)

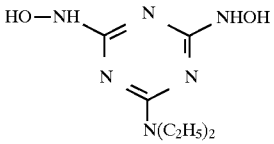

(b)

-continued

Nucleating Accelerator-1

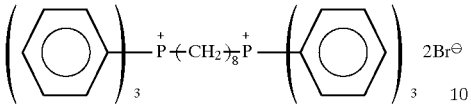

10 mg/m$^2$

Nucleating Accelerator-2

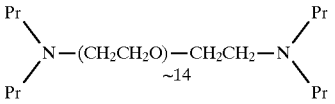

10 mg/m$^2$

An upper protective layer and a lower protective layer were formed on the emulsion layer, respectively, to prepare samples shown in Table 3. The upper protective layer comprised 0.5 g/m$^2$ of gelatin, 40 mg/m$^2$ of amorphous silicon dioxide having an average grain size of about 3.5 $\mu$m as a matting agent, 50 mg/m$^2$ of a silicone oil, 80 mg/m$^2$ of colloidal silica, and 5 mg/m$^2$ of a fluorine type surfactant represented by the following formula (c) and 100 mg/m$^2$ of sodium dodecylbenzenesulfonate as coating assistants. The lower layer comprised 0.8 g/m$^2$ of gelatin, 100 mg/m$^2$ of hydroquinone, 400 mg/m$^2$ of an ethyl acrylate latex and the following dyes.

-continued

Mixture of Dyes [a], [b] and [c]

Dye [a] 50 mg/m$^2$

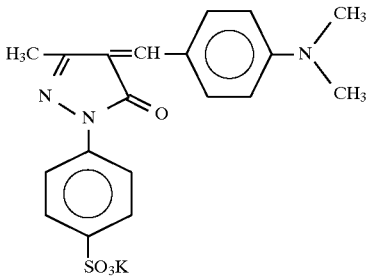

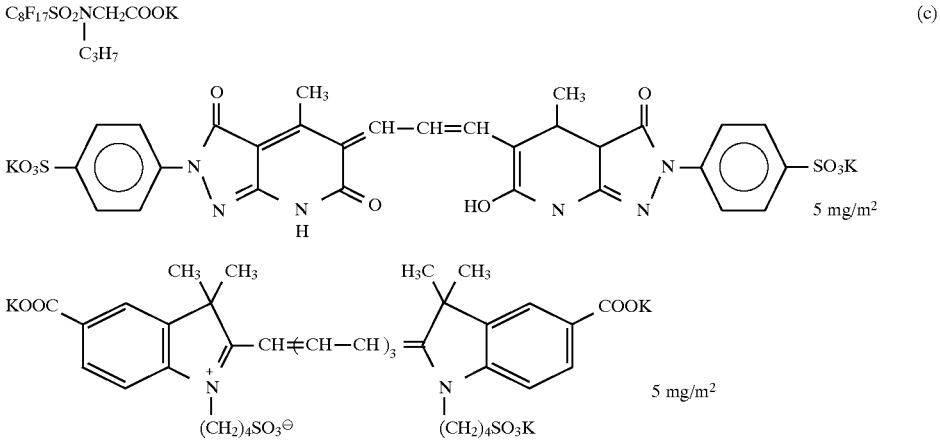

(c)

5 mg/m$^2$ 5 mg/m$^2$

A backing layer and a backing-protective layer having respective formulas described below were formed.

[Formula for Backing Layer]

| | |
|---|---|
| Gelatin | 3 g/m$^2$ |
| Polyethyl Acrylate Latex | 2 g/m$^2$ |
| Sodium p-Dodecylbenzenesulfonate | 40 mg/m$^2$ |
| Polyvinyl Benzenesulfonic Acid Potassium Salt | 30 mg/m$^2$ |
| $CH_2{=}CHSO_2CH_2CONH$ ┐ $(CH_2)_2$ $CH_2{=}CHSO_2CH_2CONH$ ┘ | 110 mg/m$^2$ |
| $SiO_2$/Sb (Weight Ratio: 90:10, Average Grain Size: 0.20 $\mu$m) | 200 mg/m$^2$ |

-continued

Dye [b] 100 mg/m$^2$

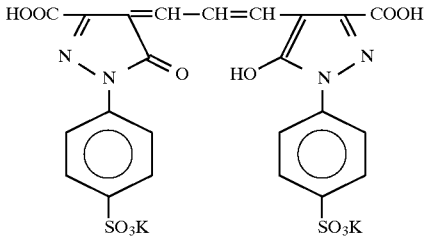

-continued

Dye [c] 50 mg/m$^2$

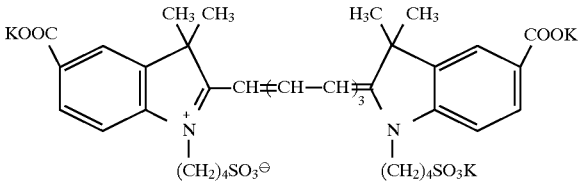

[Formula for Backing Protective Layer]

| | |
|---|---|
| Gelatin | 0.8 mg/m$^2$ |
| Finely Powdered Polymethyl Methacrylate (Average Grain Size: 4.5 μm) | 30 mg/m$^2$ |
| Sodium Dihexyl-α-sulfosuccinate | 15 mg/m$^2$ |
| Sodium p-Dodecylbenzenesulfonate | 15 mg/m$^2$ |
| Sodium Acetate | 40 mg/m$^2$ |

About the samples thus prepared, the evaluation of photographic performance was carried out by use of the developers shown in Table 1 and the fixer described below. The result, which is shown in Table 3, indicates that the 15 combinations of the present invention (Experiment No. 2, 3, 5, 6, 7, 8, 11, and 12) are satisfactory in sensitivity, gradation, and prevention of black peppers.

Evaluation was carried out in the following manner.

[Photographic Properties]

The samples thus prepared were exposed to xenon flash light having an emission time of $10^{-6}$ sec through an interference filter having a peak of 780 nm and a continuous step wedge, and processed at 35° C. for 30 sec by use of an automatic processor FG-680A (manufactured by Fuji Photo Film Co., Ltd.) with the developers shown in Table 1 and the fixer having the following composition. The result of evaluation is shown in Table 3.

The sensitivity is defined as a relative value of the reciprocal of the exposure quantity giving a density of 1.5, when the samples are processed at 35° C. for 30 sec. γ is shown as follows:

$$\gamma = \frac{3.0 - 0.3}{\log(EQ^{*1}\text{ giving density }3.0) - \log(EQ^{*1}\text{ giving density }0.3)}$$

*1 *EQ*: exposure quantity

[Evaluation of Prevention of Black Peppers]

About black peppers, non-exposure areas processed at 350° C. for 40 sec were observed with a microscope, and the result of evaluation were divided into five grades. Grade [5] represents the best quality and grade [1] the worst quality. Grades [5] and [4] show to have practically usable quality; grade [3] exhibit inferior quality, but shows to be critically usable; and grades [2] and [1] show to have practically unusable quality.

[Fixer]

| | |
|---|---|
| Ammonium Thiosulfate | 119.7 g |
| Disodium Ethylenediaminetetraacetate Dihydrate | 0.03 g |
| Sodium Thiosulfate Pentahydrate | 10.9 g |
| Sodium Sulfite | 25.0 g |
| Sodium Hydroxide (Net Weight) | 12.4 g |
| Glacial Acetic Acid | 29.1 g |
| Tartaric Acid | 2.92 g |
| Sodium Gluconate | 1.74 g |

-continued

[Fixer]

| | |
|---|---|
| Aluminum Sulfate | 8.4 g |
| PH (Adjusted with Sulfuric Acid or Sodium Hydroxide) | 4.8 |
| Total volume was adjusted to 1 liter with water. | |

TABLE 3

| Experiment No | Emulsion | Developer | Photographic Sensitivity | Characteristics γ | Prevention of Black Peppers | Note |
|---|---|---|---|---|---|---|
| 1 | A | D-1 | 100 | 18 | 2 | CE*1 |
| 2 | A | D-4 | 100 | 19 | 5 | PI*2 |
| 3 | A | D-5 | 100 | 19 | 5 | PI |
| 4 | B | D-1 | 98 | 20 | 2 | CE |
| 5 | B | D-4 | 95 | 21 | 5 | PI |
| 6 | B | D-5 | 98 | 21 | 5 | PI |
| 7 | C | D-1 | 107 | 21 | 1 | CE |
| 8 | C | D-4 | 107 | 22 | 5 | PI |
| 9 | C | D-5 | 110 | 23 | 5 | PI |
| 10 | D | D-1 | 110 | 22 | 1 | CE |
| 11 | D | D-4 | 110 | 23 | 5 | PI |
| 12 | D | D-5 | 110 | 22 | 5 | PI |
| 13 | E | D-1 | 123 | 16 | 1 | CE*1 |
| 14 | E | D-4 | 120 | 12 | 3 | CE |
| 15 | E | D-5 | 120 | 13 | 3 | CE |
| 16 | F | D-1 | 135 | 15 | 1 | CE |
| 17 | F | D-4 | 132 | 12 | 2 | CE |
| 18 | F | D-5 | 135 | 11 | 2 | CE |

*1CE: Comparative Example
*2PI: Present Invention

EXAMPLE 3

Combination of the samples used in experiment Nos. 1, 7 and 13 of Example 2 with the developers D-1 to D-7 shown in Table 1 were evaluated similarly to Example 2. The result, which is shown in Table 4, indicates that the combinations of the present invention (experiment Nos. 21 to 25 and 28 to 32) have good quality.

TABLE 4

| Experiment No | Emulsion | Developer | Photographic Sensitivity | Characteristics γ | Prevention of Black Peppers | Note |
|---|---|---|---|---|---|---|
| 19 | A | D-1 | 1.00 | 18 | 2 | CE*1 |
| 20 | A | D-2 | 91 | 13 | 3 | CE |
| 21 | A | D-3 | 93 | 16 | 5 | PI*2 |
| 22 | A | D-4 | 100 | 19 | 5 | PI |
| 23 | A | D-5 | 100 | 19 | 5 | PI |
| 24 | A | D-6 | 102 | 20 | 5 | PI |
| 25 | A | D-7 | 102 | 21 | 5 | PI |
| 26 | C | D-1 | 107 | 21 | 1 | CE |
| 27 | C | D-2 | 93 | 15 | 2 | CE |
| 28 | C | D-3 | 95 | 17 | 5 | PI |
| 29 | C | D-4 | 107 | 22 | 5 | PI |
| 30 | C | D-5 | 107 | 23 | 5 | PI |
| 31 | C | D-6 | 110 | 23 | 5 | PI |
| 32 | C | D-7 | 110 | 24 | 5 | PI |
| 33 | E | D-1 | 123 | 16 | 1 | CE*1 |
| 34 | E | D-2 | 105 | 10 | 3 | CE |
| 35 | E | D-3 | 89 | 8 | 5 | CE |
| 36 | E | D-4 | 120 | 12 | 3 | CE |
| 37 | E | D-5 | 120 | 13 | 3 | CE |
| 38 | E | D-6 | 123 | 11 | 3 | CE |
| 39 | E | D-7 | 126 | 12 | 3 | CE |

*1CE: Comparative Example
*2PI: Present Invention

EXAMPLE 4

The combination of the hydrazine derivatives used in the sample of Example 2 was replaced by a combination of hydrazine derivatives I-10 and I-29 and by a combination of hydrazine derivatives I-33 and I-24. The result also indicates that the constitution of the present invention is satisfactory.

EXAMPLE 5

Although infrared sensitizing dye IR-6 was replaced by IR-12 or IR-20, the constitution of the present invention exhibited good quality.

What is claimed is:

1. A method for forming an image which comprises the steps of image-exposing a silver halide photographic material having a silver halide emulsion layer provided on a support, said silver halide emulsion layer comprising silver halide grains containing 50 mol % or more of silver chloride and $1\times10^{-8}$ to $1\times10^{-6}$ mol of a complex of rhodium, ruthenium, rhenium, or osmium per mol of silver halide, being spectrally sensitized so as to have the maximum sensitivity in the wavelength region of 750 nm or more, and further containing a hydrazine compound represented by the following general formula (I) in a amount of $1\times10^{-5}$ to $2\times10^{-2}$ mol per mol of silver halide; and processing with a developer which contains a developing agent represented by the following general formula (II) and does not substantially contain a developing agent of dihydroxybenzene type:

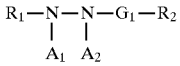

(I)

wherein $R_1$ represents an aliphatic group or an aromatic group; $R_2$ represents a hydrogen atom, an alkyl group, an aryl group, an unsaturated heterocyclic group, an alkoxyl group, an aryloxy group, an amino group, or a hydrazino group; $G_1$ represents a —CO— group, a —$SO_2$— group, a —SO— group, a

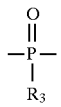

group, a —CO—CO— group, a thiocarbonyl group, or an iminoethylene group; both of $A_1$ and $A_2$ are hydrogen atoms, or one of $A_1$ and $A_2$ is a hydrogen atom and the other is a substituted or unsubstituted alkylsulfonyl group, a substituted or unsubstituted arylsulfonyl group, or a substituted or unsubstituted acyl group; $R_3$ represents one selected from the same groups as defined as $R_2$ and may be different from $R_2$ in a molecule;

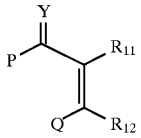

(II)

wherein $R_{11}$ and $R_{12}$ each represents a hydroxyl group, an amino group, an acylamino group, an alkylsulfonylamino group, an arylsulfonylamino group, an alkoxycarbonylamino group, a mercapto group, or an alkylthio group; P and Q each represents a hydroxyl group, a carboxyl group, an alkoxyl group, a hydroxyalkyl group, a carboxyalkyl group, a sulfo group, a sulfoalkyl group, an amino group, an aminoalkyl group, an alkyl group, or an aryl group, or P and Q may combine with each other to form one of 5- to 8-membered rings together with two vinyl carbon atoms to which $R_{11}$ and $R_{12}$ attach and with a carbon atom to which Y attaches; Y represents O or N—$R_{13}$; and $R_{13}$ represents a hydrogen atom, a hydroxyl group, an alkyl group, an acyl group, a hydroxyalkyl group, a sulfoalkyl group, or a carboxyalkyl group;

wherein said silver halide grains are sensitized by use of a selenium sensitizer or a tellurium sensitizer; and wherein said silver halide emulsion layer is spectrally sensitized in the infrared region by an infrared sensitizing dye.

2. A method for forming an image as claimed in claim 1, wherein the content of said infrared sensitizing dye is in the range of from $5\times10^{-7}$ to $5\times10^{-3}$ mol/mol of silver halide.

3. A method for forming an image as claimed in claim 1, wherein the compound represented by formula II is in the range of from $5\times10^{-3}$ to 1 mol/liter of developer.

4. A method for forming an image as claimed in claim 1, wherein said developer further contains at least one of a 1-phenyl-3-pyrazolidone type compound and a p-aminophenol type compound.

5. A method for forming an image as claimed in claim 1, wherein the pH range of said developer is from 9.5 to 11.0.

* * * * *